US010883672B1

(12) United States Patent
DeSena, Jr.

(10) Patent No.: US 10,883,672 B1
(45) Date of Patent: Jan. 5, 2021

(54) REFLECTOR STRUCTURES FOR LIGHTING DEVICES

(71) Applicant: IDEAL Industries Lighting, LLC, Durham, NC (US)

(72) Inventor: P. Joseph DeSena, Jr., Raleigh, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

(21) Appl. No.: 16/667,315

(22) Filed: Oct. 29, 2019

(51) Int. Cl.

| | |
|---|---|
| ***F21K 9/68*** | (2016.01) |
| ***F21K 9/66*** | (2016.01) |
| ***F21V 7/05*** | (2006.01) |
| ***F21V 7/24*** | (2018.01) |
| ***F21K 9/62*** | (2016.01) |
| ***F21V 7/00*** | (2006.01) |
| ***F21S 8/02*** | (2006.01) |
| *F21Y 115/10* | (2016.01) |
| *F21Y 103/10* | (2016.01) |
| *F21Y 105/16* | (2016.01) |
| *F21Y 113/13* | (2016.01) |

(52) U.S. Cl.
CPC ..... *F21K 9/68* (2016.08); *F21K 9/62* (2016.08); *F21K 9/66* (2016.08); *F21S 8/026* (2013.01); *F21V 7/0008* (2013.01); *F21V 7/05* (2013.01); *F21V 7/24* (2018.02); *F21Y 2103/10* (2016.08); *F21Y 2105/16* (2016.08); *F21Y 2113/13* (2016.08); *F21Y 2115/10* (2016.08)

(58) Field of Classification Search
None
See application file for complete search history.

(56) References Cited

U.S. PATENT DOCUMENTS

| | | | |
|---|---|---|---|
| 8,759,847 | B2 | 6/2014 | Xu et al. |
| 9,052,075 | B2 | 6/2015 | Demuynck et al. |
| 9,241,384 | B2 | 1/2016 | van de Ven et al. |
| D749,768 | S | 2/2016 | Snell et al. |
| 9,530,944 | B2 | 12/2016 | Jacobson et al. |
| D786,471 | S | 5/2017 | Snell et al. |

(Continued)

OTHER PUBLICATIONS

Q. Wang et al, Influence of Color Temperature on Comfort and Preference for LED Indoor Lighting, 2017, Elsevier, Optik 129 (2017 ), pp. 21-29 (Year: 2017).*

(Continued)

*Primary Examiner* — Evan P Dzierzynski
*Assistant Examiner* — Keith G. Delahoussaye
(74) *Attorney, Agent, or Firm* — Withrow & Terranova, P.L.L.C.

(57) ABSTRACT

Solid state lighting devices are configured to provide aggregate emissions that include emissions from solid state light emitters and emissions that are received by preferential reflector structures. Preferential reflectors have non-uniform spectral reflectivities that preferentially reflect certain wavelengths of emissions that are received from solid state light emitters. Solid state lighting devices include solid state light emitters of different correlated color temperature (CCT) values and one or more preferential reflectors configured to shift CCT values of aggregate emissions of such solid state lighting devices, such as to provide tunable aggregate emissions between multiple CCT values along or near a black body locus.

24 Claims, 17 Drawing Sheets

(56) References Cited

U.S. PATENT DOCUMENTS

| | | | | |
|---|---|---|---|---|
| 10,012,354 | B2 | 7/2018 | Bernard et al. | |
| 10,074,635 | B2 | 9/2018 | Tiwari et al. | |
| 10,228,111 | B2 | 3/2019 | Demuynck et al. | |
| 10,247,372 | B2 | 4/2019 | Wilcox et al. | |
| 10,274,171 | B2 | 4/2019 | Goelz et al. | |
| 10,302,262 | B2 | 5/2019 | Huang et al. | |
| 2005/0275937 | A1* | 12/2005 | Wu | H04N 9/315 359/359 |
| 2005/0275960 | A1 | 12/2005 | Wu et al. | |
| 2010/0140634 | A1* | 6/2010 | van de Ven | H01L 25/0753 257/88 |
| 2015/0076534 | A1 | 3/2015 | Terakami et al. | |
| 2019/0057954 | A1 | 2/2019 | Blakely et al. | |
| 2019/0058003 | A1 | 2/2019 | Blakely et al. | |

OTHER PUBLICATIONS

DLC, "Testing and Reporting Requirements for Color-Tunable Products," Mar. 26, 2018, available at https://www.designlights.org/solid-state-lighting/testing-reporting-requirements/color-tunable-products/, 9 pages.

* cited by examiner

REFLECTOR STRUCTURES FOR LIGHTING DEVICES

TECHNICAL FIELD

The present disclosure relates to lighting devices, and more particularly to solid-state lighting devices with reflector structures arranged to receive emissions from solid state light emitters.

BACKGROUND

Solid-state lighting devices such as light-emitting diodes (LEDs) are increasingly used in both consumer and commercial applications. Advancements in LED technology have resulted in highly efficient and mechanically robust light sources with long service life. Accordingly, modern LEDs have enabled a variety of new display applications and are being increasingly utilized for general illumination applications, often replacing incandescent and fluorescent light sources.

Solid state emitters such as LEDs or lasers may be used to provide white light (e.g., perceived as being white or near-white), and are increasingly provided as replacements for light sources of white incandescent lamps and lighting fixtures. Solid state emitters may include lumiphoric materials (also known as lumiphors) that absorb a portion of emissions having a first peak wavelength emitted by the emitter and re-emit light having a second peak wavelength that differs from the first peak wavelength. Phosphors, scintillators, and lumiphoric inks are common lumiphoric materials. Light perceived as white or near-white may be generated by a combination of red, green, and blue ("RGB") emitters, or, alternatively, by combined emissions of a blue LED and a lumiphor such as a yellow phosphor (e.g., YAG:Ce or Ce:YAG). In the latter case, a portion of the blue LED emissions pass through the phosphor, while another portion of the blue emissions is downconverted to yellow, and the blue and yellow light in combination are perceived as white. White light may also be produced by stimulating phosphors or dyes of multiple colors with a violet or ultraviolet (UV) LED source.

Lighting devices and fixtures having white light emission characteristics are desirable for use in everyday lighting applications. In order to generate desired emission characteristics, it is sometimes necessary to adjust and/or mix emissions of different solid state emitters and lumiphors within lighting devices to provide a desired correlated color temperature (CCT) or color point. However, it may be challenging to adjust CCT or the color point of aggregated emissions of a device without adding increased complexity.

The art continues to seek improved lighting devices providing desirable illumination characteristics, as well as improved methods for making and using solid state devices.

SUMMARY

Aspects disclosed herein relate to solid state lighting devices that are configured to provide aggregate emissions that include emissions from solid state light emitters and emissions that are reflected by preferential reflector structures. Preferential reflectors have non-uniform spectral reflectivities that preferentially reflect certain wavelengths of emissions received from solid state light emitters. One or more preferential reflectors may be utilized in solid state lighting devices incorporating solid state light emitters of different correlated color temperature (CCT) values and one or more preferential reflectors configured to shift CCT values of aggregate emissions of such solid state lighting devices. Such arrangements may provide solid state lighting devices with reduced complexity and reduced cost, while providing aggregate emissions that are tunable between multiple CCT values along or near a black body locus.

In one aspect, a solid state lighting device comprises: at least one first solid state light emitter configured to produce first emissions having a first CCT; at least one second solid state light emitter configured to produce second emissions having a second CCT, wherein the second CCT differs from the first CCT by at least 300 Kelvin (K); and a preferential reflector arranged to receive at least a portion of each of the first emissions and the second emissions, wherein the preferential reflector comprises a non-wavelength-converting material having a non-uniform spectral reflectivity exhibiting a peak reflectivity within a range of 510 nanometers (nm) to 580 nm.

In certain embodiments, the at least one first solid state light emitter and the at least one second solid state light emitter are separately controllable relative to one another such that the solid state lighting device is tunable among multiple CCT values between the first CCT and the second CCT. In certain embodiments, the solid state lighting device is devoid of any solid state light emitters that are configured to provide emissions having a third CCT value that differs from both of the first CCT and the second CCT by more than 300 K.

In certain embodiments, aggregate emissions of the solid state lighting device are tunable between multiple CCT values along a black body locus. In certain embodiments, the preferential reflector is configured to shift delta u'v' values of aggregate emissions of the solid state lighting device in a range between 0 and 0.004.

In certain embodiments, the preferential reflector comprises at least one pigment material of a color corresponding to a wavelength within the peak reflectivity range. In certain embodiments, the preferential reflector further comprises an adhesive tape that includes the at least one pigment material. In certain embodiments, the preferential reflector further comprises a binder, and wherein the at least one pigment material is embedded within the binder. In certain embodiments, the preferential reflector comprises a paint having the at least one pigment material mixed therein.

In certain embodiments, the solid state lighting device further comprises a housing and an optic defining a mixing chamber therebetween, with the at least one first solid state emitter and the at least one second solid state emitter being arranged within the mixing chamber. In certain embodiments, the preferential reflector is arranged within the mixing chamber. In certain embodiments, the preferential reflector is arranged outside of the mixing chamber.

In certain embodiments, the housing forms a pedestal on which the at least one first solid state light emitter and the at least one second solid state light emitter are mounted, and the preferential reflector is arranged on a portion of the housing that is adjacent to the pedestal.

In certain embodiments, the housing forms a portion of a troffer lighting fixture. In certain embodiments, the troffer lighting fixture comprises an indirect light configuration in which the at least one first solid state light emitter and the at least one second solid state light emitter are oriented away from a primary emission direction of the troffer lighting fixture.

In certain embodiments, the optic comprises a lens. In certain embodiments, the optic comprises a waveguide optic.

In another aspect, a solid state lighting device comprises: at least one first solid state light emitter configured to produce first emissions having a first CCT; at least one second solid state light emitter configured to produce second emissions having a second CCT, wherein the second CCT differs from the first CCT by at least 300 K; and a preferential reflector arranged to receive at least a portion of each of the first emissions and the second emissions; wherein the preferential reflector comprises a non-wavelength-converting material having a non-uniform spectral reflectivity, and aggregate emissions of the solid state lighting device are tunable between multiple CCT values along a black body locus.

In certain embodiments, the solid state lighting device is devoid of any solid state light emitters that are configured to provide emissions having a third CCT value that differs from both of the first CCT and the second CCT by more than 300 K. In certain embodiments, the at least one first solid state light emitter and the at least one second solid state light emitter are separately controllable relative to one another such that the solid state lighting device is tunable among multiple CCT values between the first CCT and the second CCT. In certain embodiments, the second CCT differs from the first CCT by at least 2000 K.

In certain embodiments, the at least one first solid state light emitter comprises a first light emitting diode (LED) chip and a first lumiphoric material that are configured to produce the first emissions, and the at least one second solid state light emitter comprises a second LED chip and a second lumiphoric material that are configured to produce the second emissions.

In certain embodiments, the preferential reflector is configured to shift delta u'v' values of the aggregate emissions of the solid state lighting device in a range between 0 and 0.004. In certain embodiments, the non-uniform spectral reflectivity exhibits a peak reflectivity within a range of 510 nanometers (nm) to 580 nm, and the preferential reflector comprises at least one pigment material having a color corresponding to a wavelength within the peak reflectivity range.

In another aspect, a solid state lighting device comprises: at least one first solid state light emitter configured to produce first emissions having a first CCT; at least one second solid state light emitter configured to produce second emissions having a second CCT, wherein the second CCT differs from the first CCT by at least 300 K; and a preferential reflector arranged to receive at least a portion of each of the first emissions and the second emissions, wherein the preferential reflector comprises a non-wavelength-converting material having a non-uniform spectral reflectivity exhibiting a peak reflectivity with a color point on a 1931 CIE Chromaticity Diagram including: x, y coordinates that define a point on or within a closed shape bounded by a first line having x, y endpoint coordinates of (0.2806, 0.2883) and (0.0139, 0.7502); a curve corresponding to a portion of a spectrum locus of the 1931 CIE Chromaticity Diagram having x, y endpoint coordinates of (0.0139, 0.7502) and (0.5125, 0.4866); a second line having x, y endpoint coordinates of (0.5267, 0.4133) and (0.5125, 0.4866); and a curve corresponding to a portion of a blackbody locus of the 1931 CIE Chromaticity Diagram having x, y endpoint coordinates of (0.2806, 0.2883) and (0.5267, 0.4133).

In another aspect, any of the foregoing aspects individually or together, and/or various separate aspects and features as described herein, may be combined for additional advantage. Any of the various features and elements as disclosed herein may be combined with one or more other disclosed features and elements unless indicated to the contrary herein.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

FIG. 3 A is a representation of the 1931 CIE Chromaticity Diagram showing the BBL and hash marks indicating CCT values thereon, overlaid with three color points A-C and three corresponding emission lines that define boundaries of a two-dimensional color region.

Figure 3A:
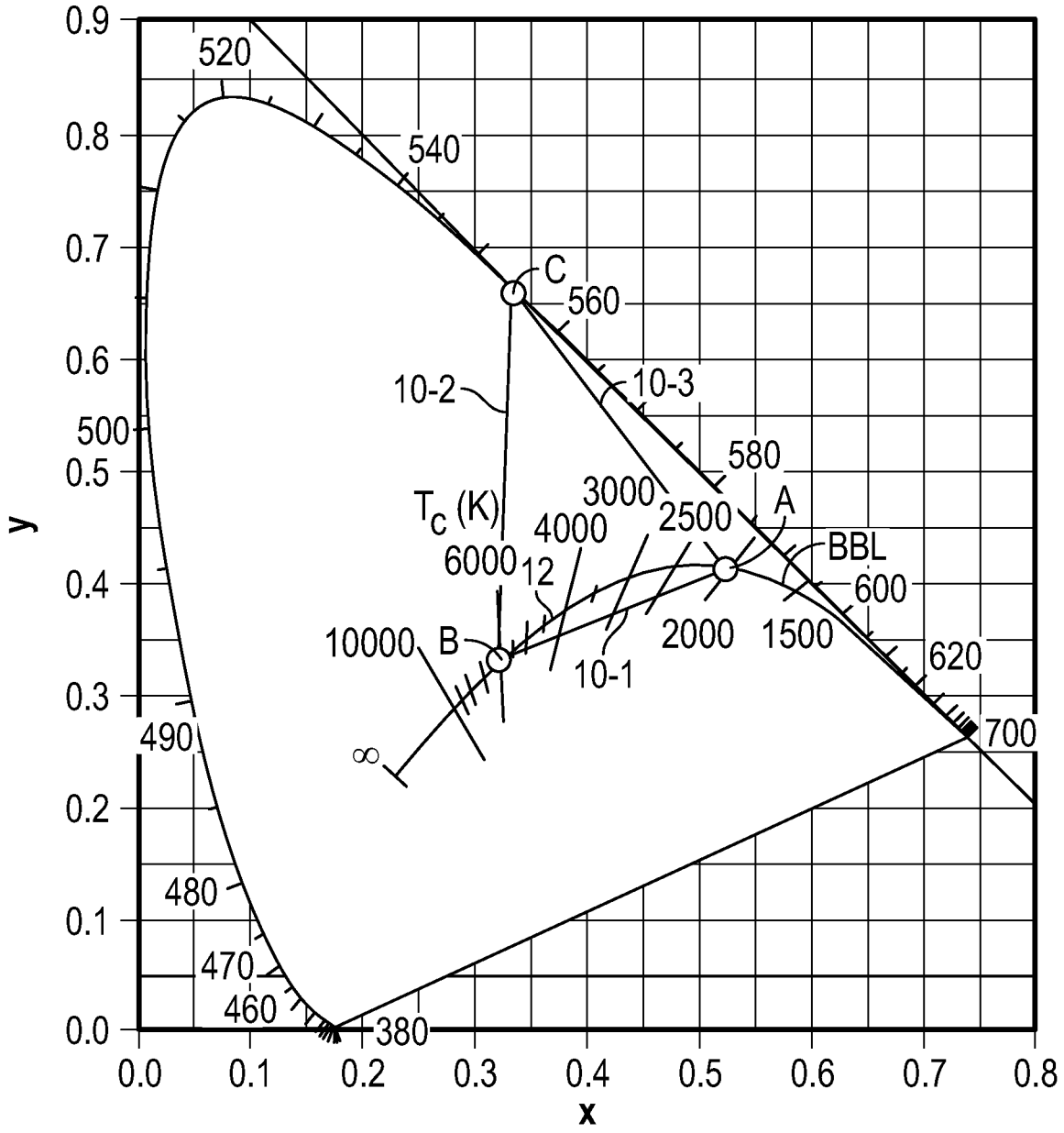
Figure 3B:
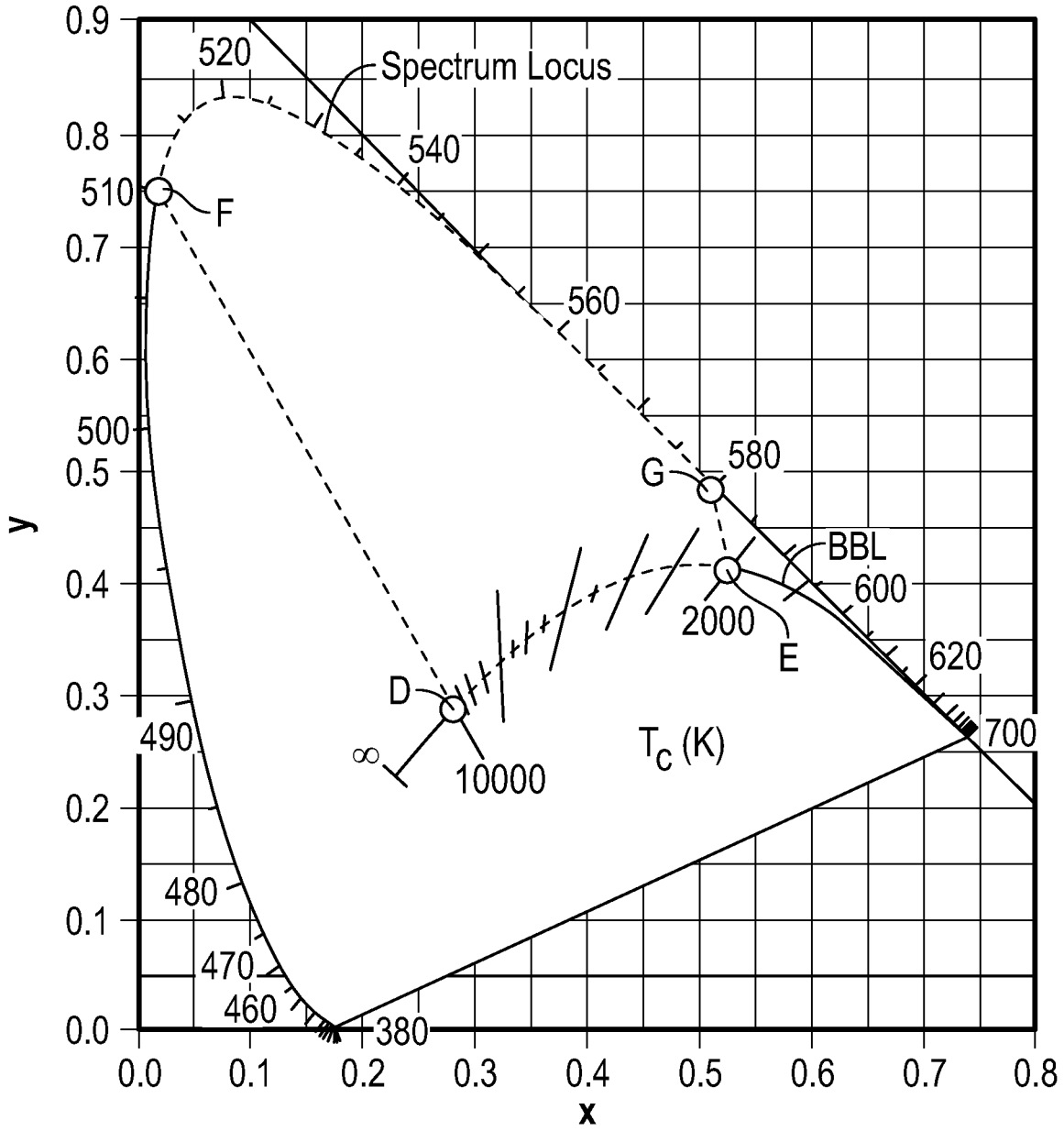

FIG. 3B is a representation of the 1931 CIE Chromaticity Diagram showing the BBL and spectrum locus, overlaid with four color points D-G that define boundaries of a closed two-dimensional color region.

Figure 4:
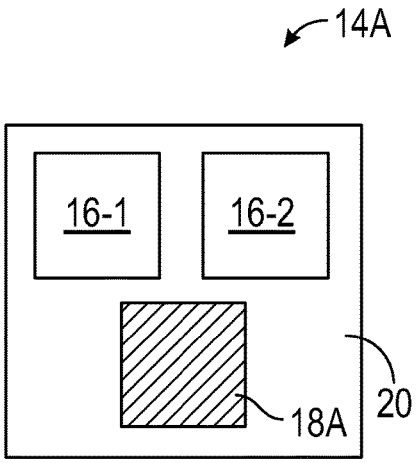

FIG. 4 is a top view schematic illustration of a solid state lighting device according to one embodiment including first and second solid state light emitters and a preferential reflector having a non-uniform spectral reflectivity according to embodiments disclosed herein.

Figure 5:
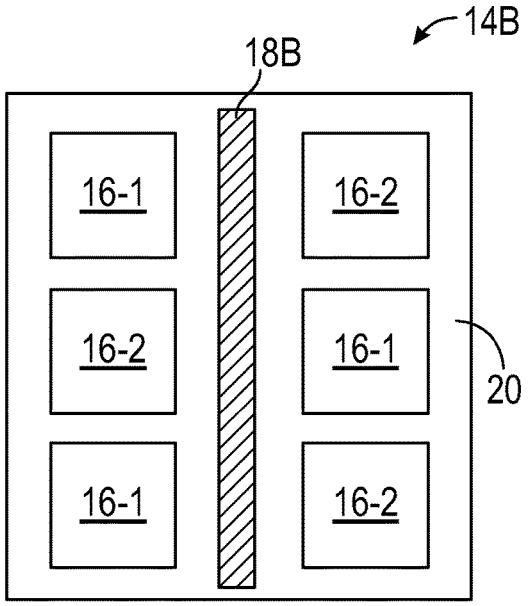

FIG. 5 is a top view illustration of a solid state lighting device according to one embodiment including a preferential reflector arranged between different ones of multiple paired first and second light emitters.

Figure 6:
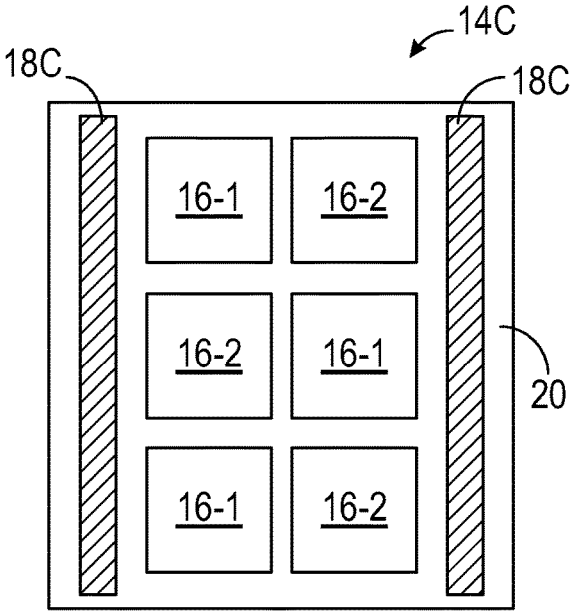

FIG. 6 is a top view illustration of a solid state lighting device according to one embodiment including a preferential reflector arranged along two sides of a periphery of multiple pairs of first and second light emitters.

Figure 7:
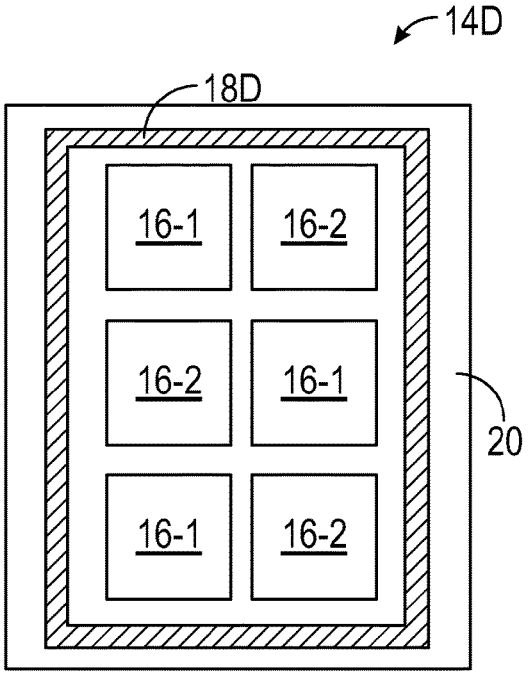

FIG. 7 is a top view illustration of a solid state lighting device according to one embodiment including a preferential reflector arranged about an entire periphery of first and second light emitters.

Figure 8:
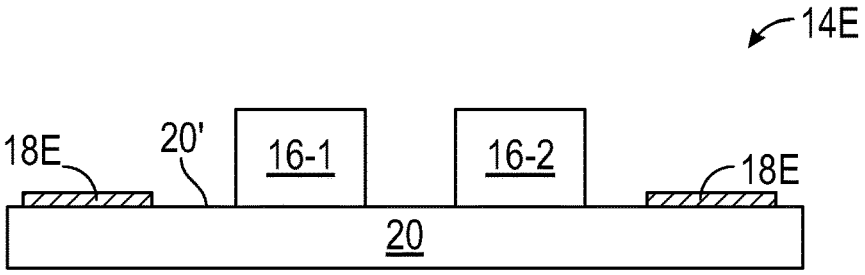

FIG. 8 is a cross-sectional view of a solid state lighting device according to certain embodiments with one or more preferential reflectors are arranged about a periphery of first and second solid state light emitters.

Figure 9:
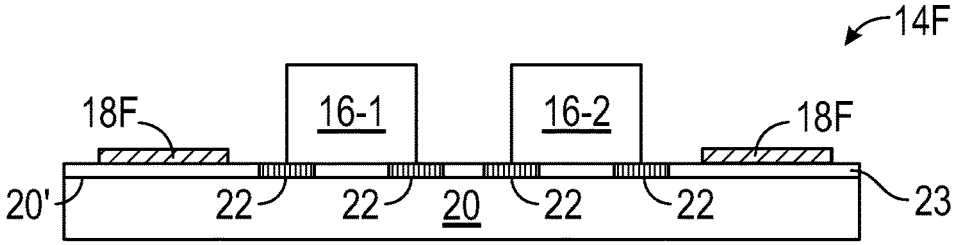

FIG. 9 is a cross-sectional view of a solid state lighting device similar to that of FIG. 8, with separate electrical connections for each of the first and second solid state light emitters, and illustrating a solder mask material between a substrate and the preferential reflectors.

Figure 10:
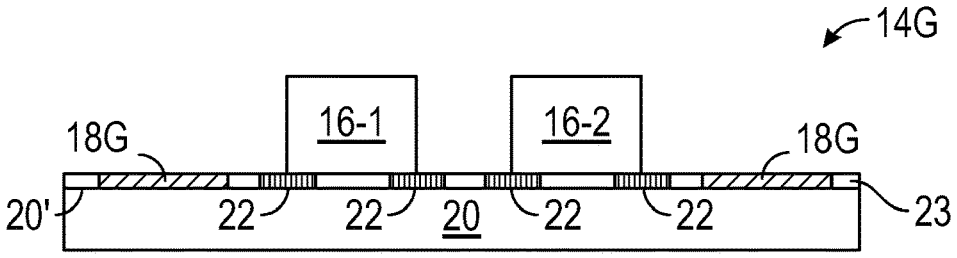

FIG. 10 is a cross-sectional view of solid state lighting device similar to that of FIG. 9, with one or more preferential reflectors arranged on a substrate and with a solder mask material laterally arranged between the preferential reflectors and electrical connections for the first and second solid state light emitters.

Figure 11:
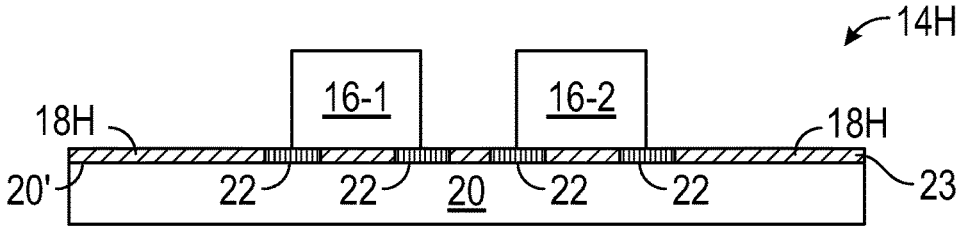

FIG. 11 is a cross-sectional view of a solid state lighting device similar to that of FIGS. 9 and 10, with one or more preferential reflectors being integrated with or otherwise provided within a solder mask material.

Figure 12:
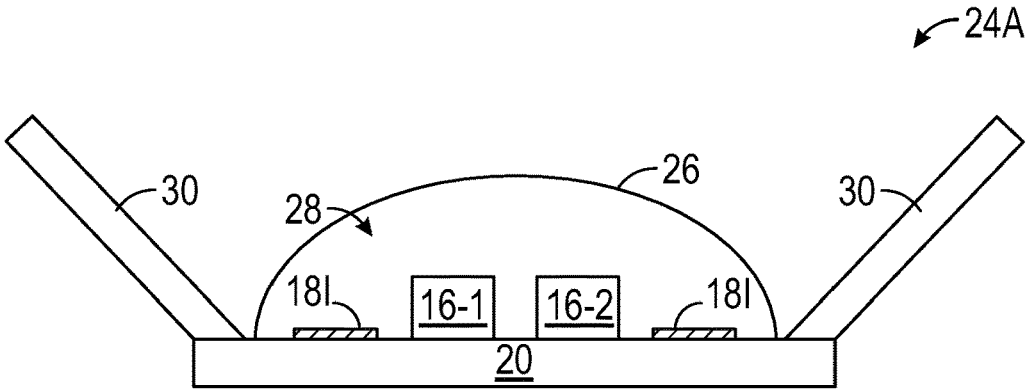

FIG. 12 is a cross-sectional view of a solid state lighting device according to one embodiment in which one or more preferential reflectors are arranged within a mixing chamber that is at least partially enclosed by an optical element of the solid state lighting device.

Figure 13:
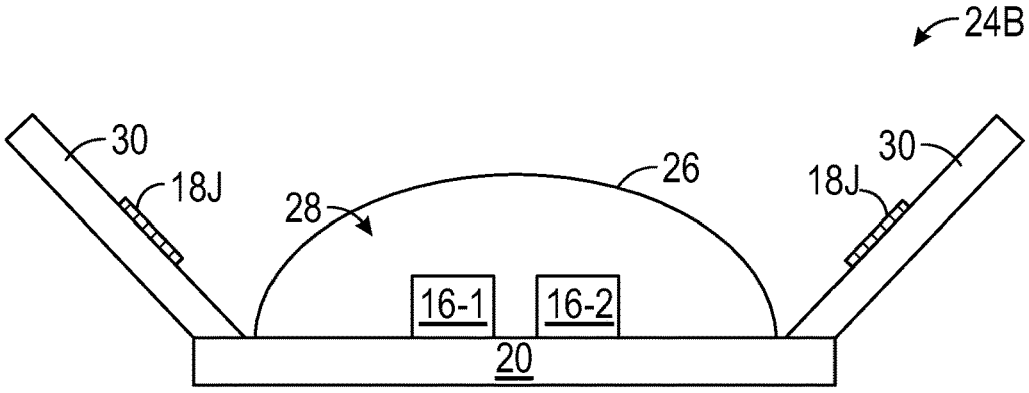

FIG. 13 is a cross-sectional view of a solid state lighting device according to one embodiment in which one or more preferential reflectors are arranged outside of a mixing chamber of the solid state lighting device.

Figure 14:
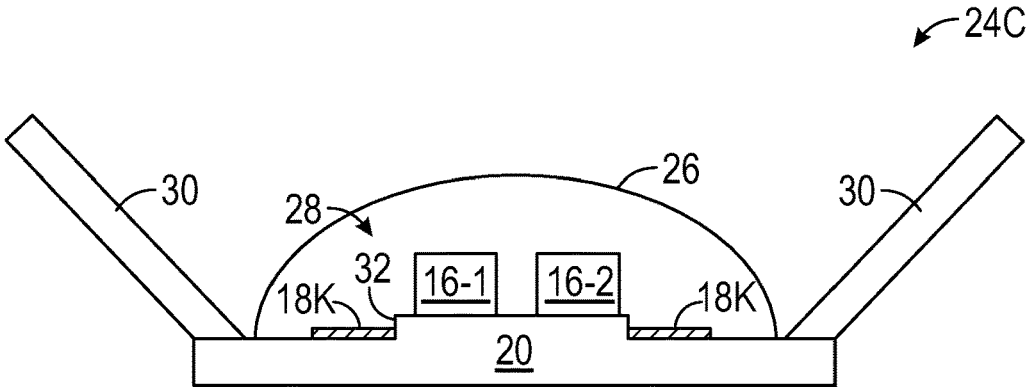

FIG. 14 is a cross-sectional view of a solid state lighting device according to one embodiment in which first and second light emitters are supported by a pedestal of the solid state lighting device, and one or more preferential reflectors are arranged adjacent to the pedestal.

Figure 15A:
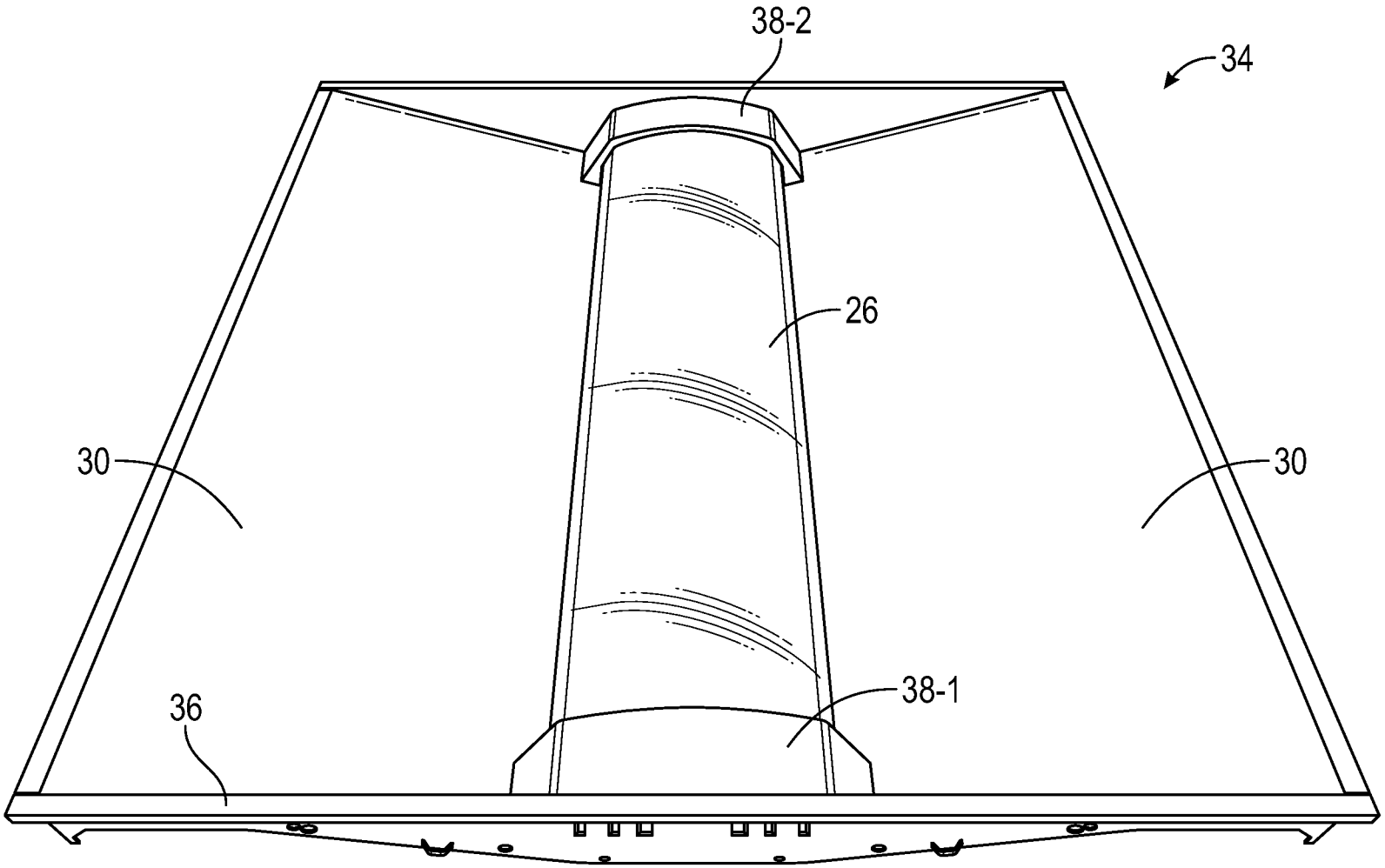

FIG. 15A is a perspective view of a troffer style lighting fixture according to certain embodiments disclosed herein.

Figure 15B:
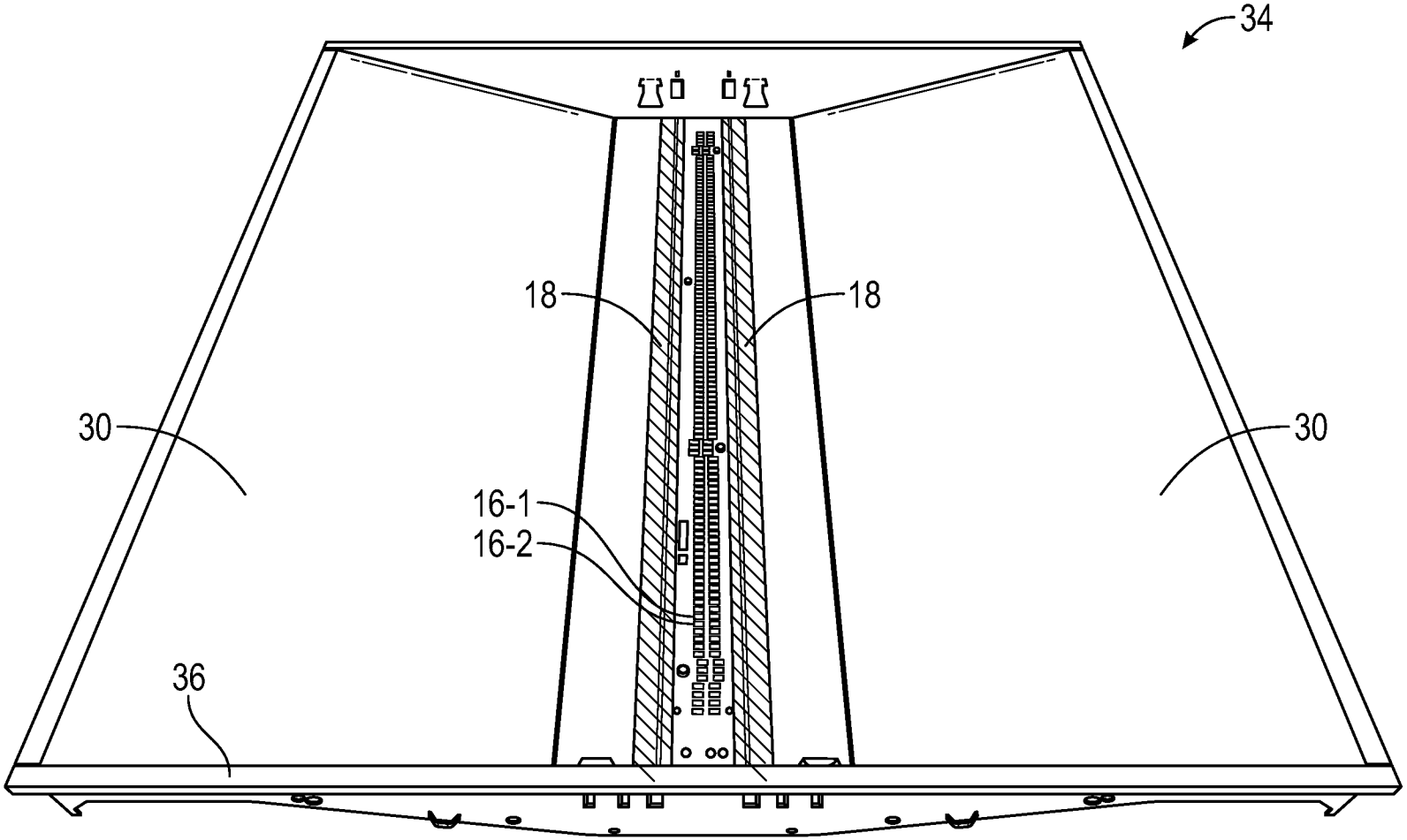

FIG. 15B is a perspective view of the lighting fixture of FIG. 15A with an optic and end caps removed to illustrate arrangements of first and second light emitters and one or more preferential reflectors.

Figure 16A:
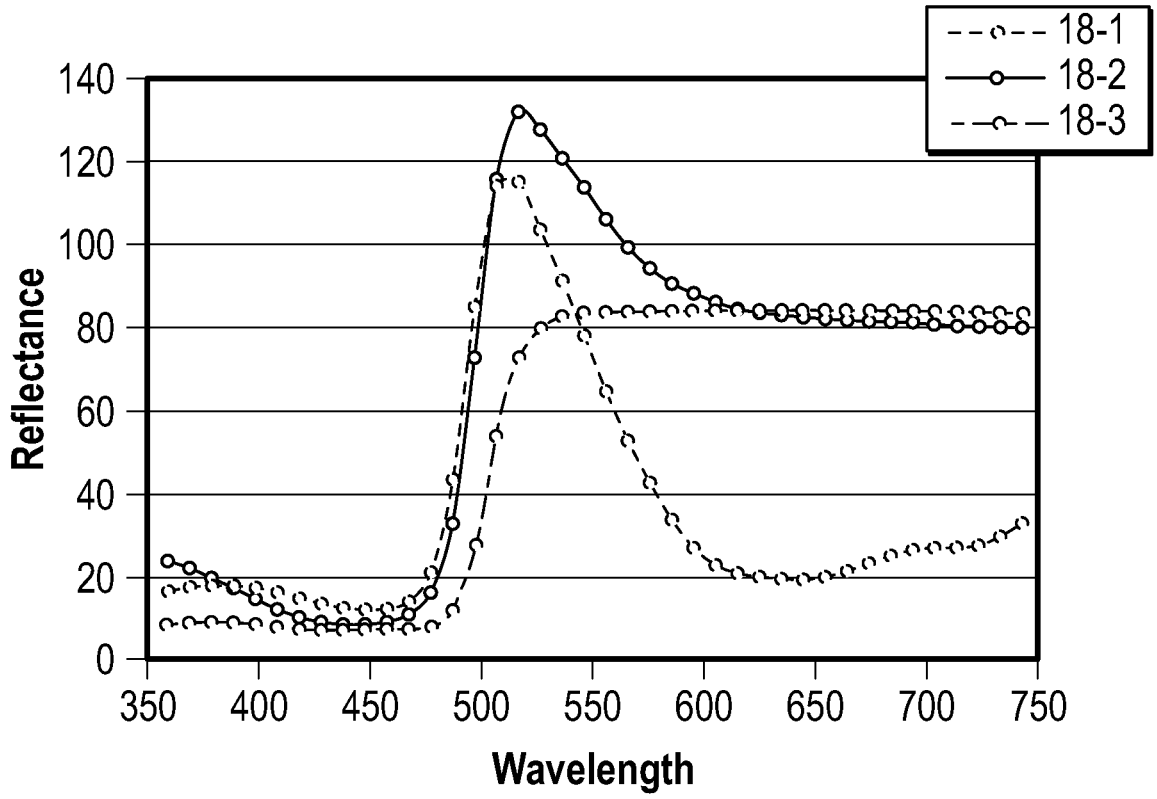

FIG. 16A is a plot representing reflectance values across a wavelength range for three different configurations of preferential reflectors.

FIGS. 16B-16E are plots of Du'v' versus CCT obtained by photometric testing of various configurations of a lighting fixture according to FIGS. 15A and 15B with the three different configurations of preferential reflectors represented in FIG. 16A.

Figure 17A:
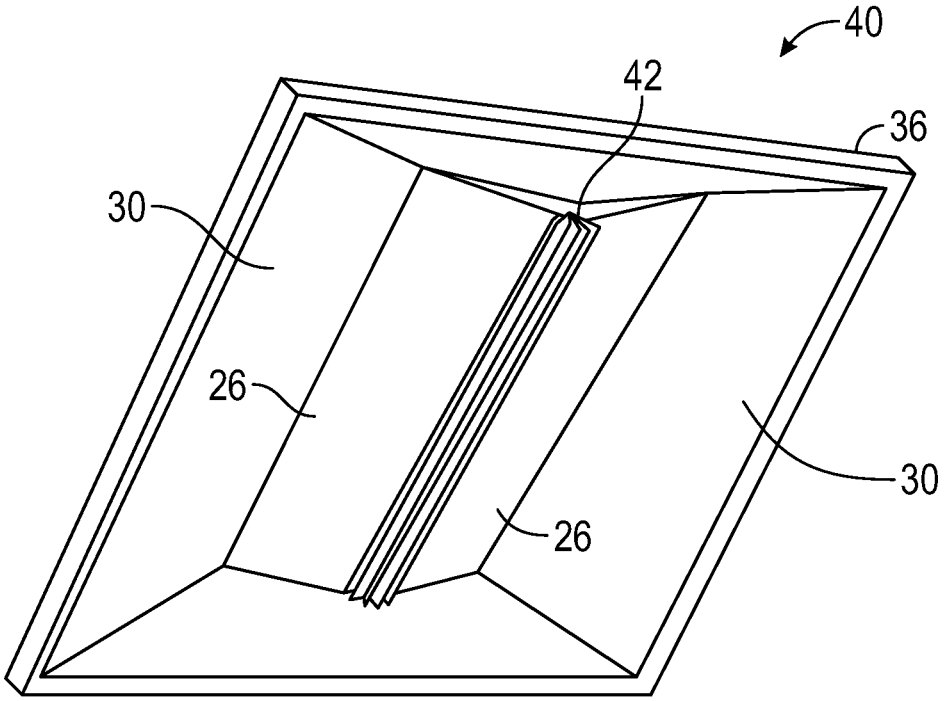

FIG. 17A is a perspective view of a lighting fixture that employs an indirect light configuration with one or more preferential reflectors according to embodiments disclosed herein.

Figure 17B:
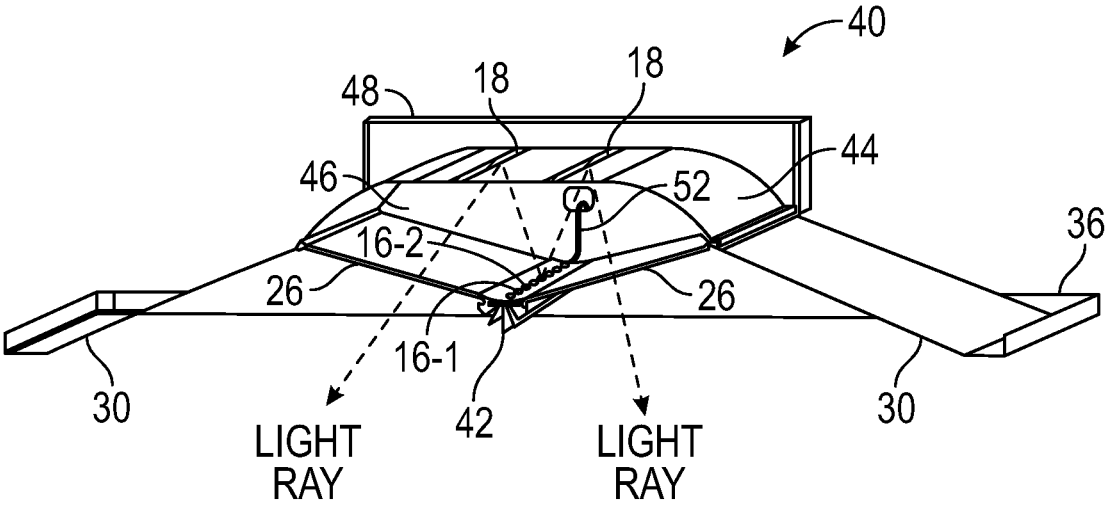

FIG. 17B is a cutaway perspective view of the lighting fixture of FIG. 17B.

Figure 18:
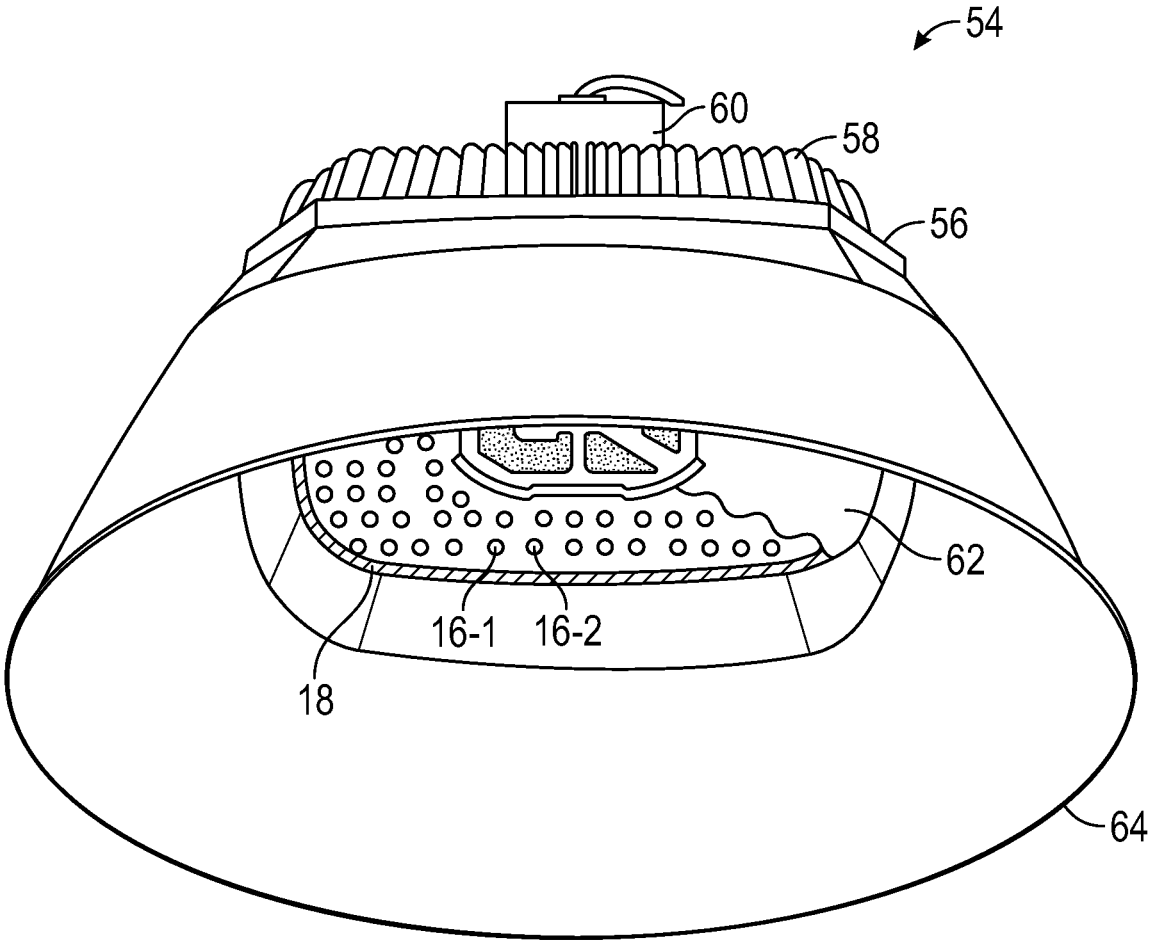

FIG. 18 is a perspective view of a high bay/low bay type solid state lighting fixture with one or more preferential reflectors according to embodiments disclosed herein.

Figure 19A:
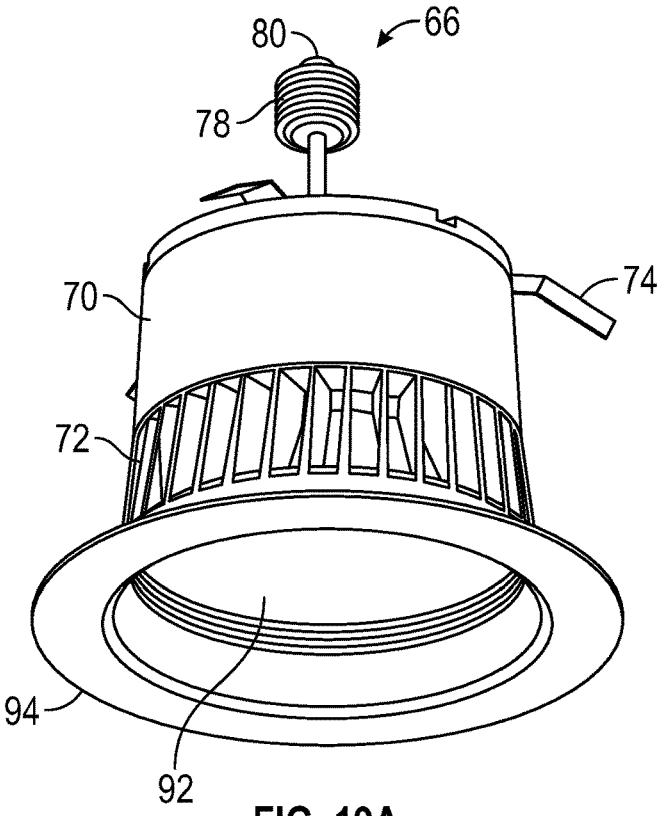

FIG. 19A is a perspective view of a cylindrical downlight intended for in-ceiling mounting and incorporating one or more preferential reflectors according to embodiments disclosed herein.

Figure 19B:
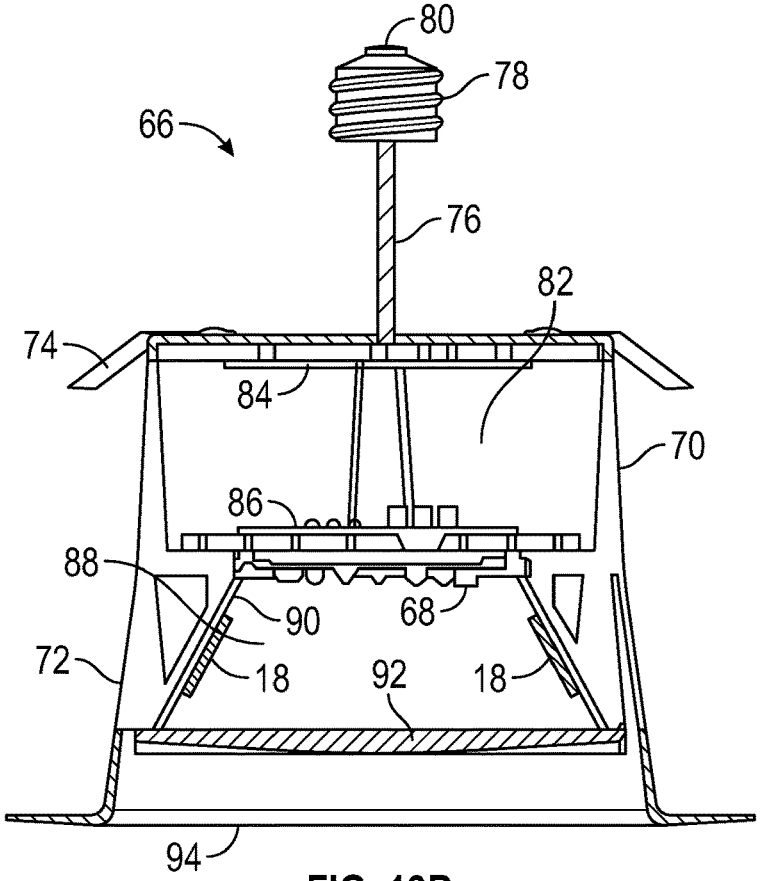

FIG. 19B is a cross-sectional view of the lighting device of FIG. 19A.

Figure 20A:
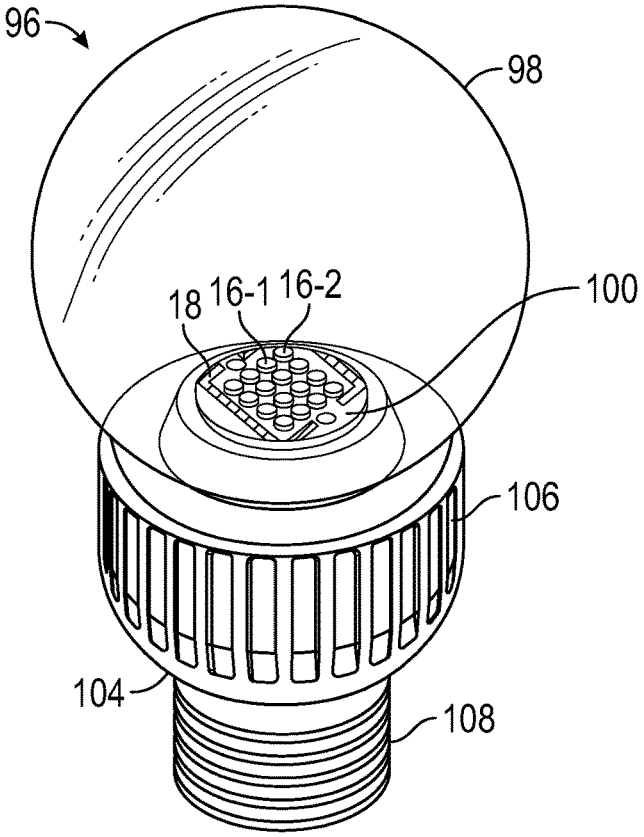

FIG. 20A is a perspective view illustrating a lighting device according to embodiments disclosed herein, embodied in a light bulb incorporating one or more preferential reflectors.

Figure 20B:
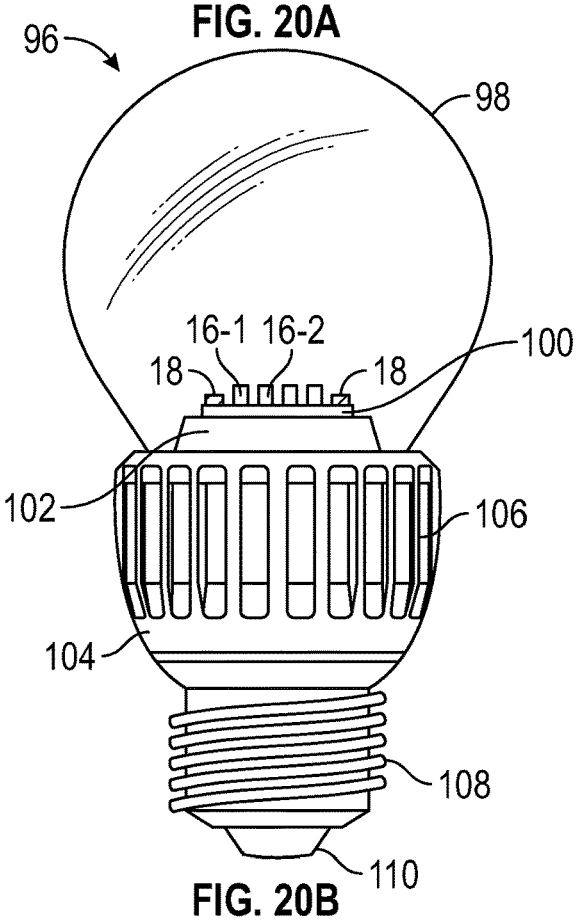

FIG. 20B is a side view of the lighting device of FIG. 20A.

Figure 21A:
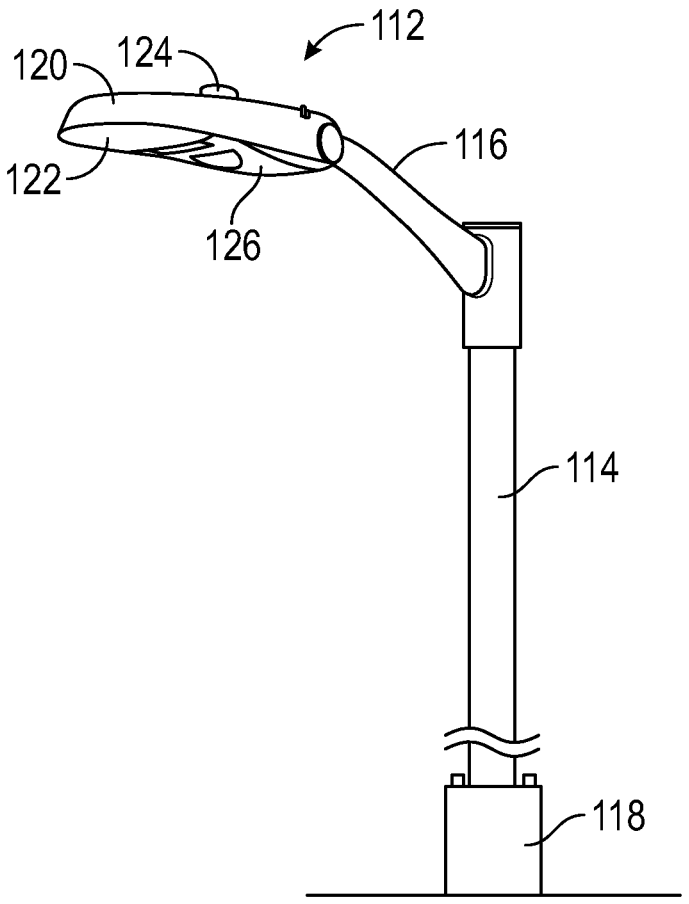

FIG. 21A is a perspective view of an outdoor floodlight (e.g., street or roadway lamp) lighting fixture incorporating one or more preferential reflectors according to embodiments disclosed herein.

Figure 21B:
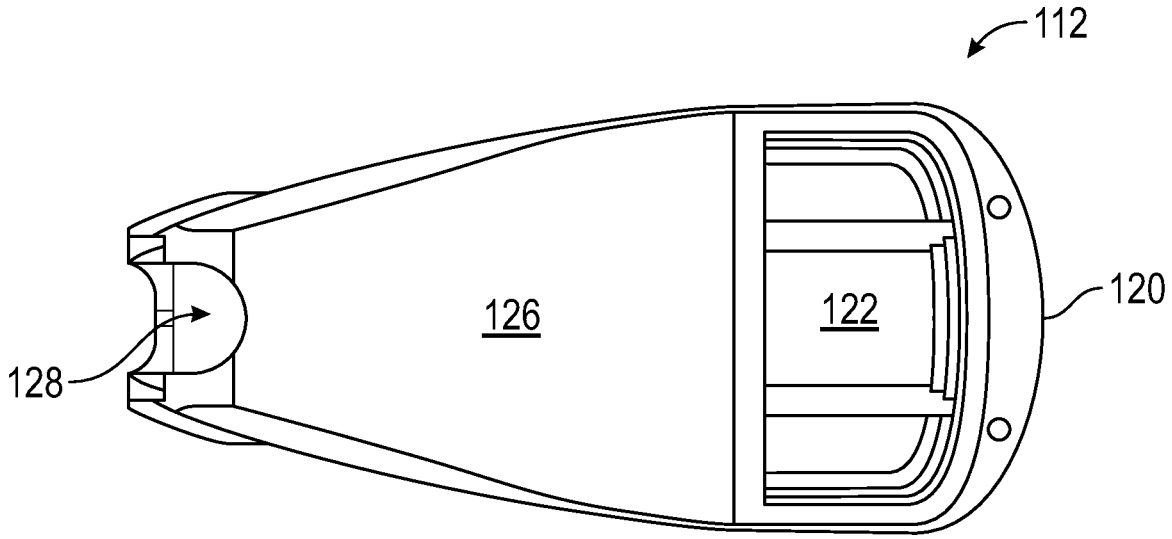

FIG. 21B is a bottom plan view of the lighting fixture of FIG. 21A.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments of the disclosure are described herein with reference to figures that are provided as schematic illustrations of various embodiments of the disclosure. As such, the actual thickness of the layers or elements can be different, and variations from the shapes of the illustrations as a result, for example, of manufacturing techniques and/or tolerances, are expected. For example, a region illustrated or described as square or rectangular can have rounded or curved features, and regions shown as straight lines may have some irregularity. Thus, the regions illustrated in the figures are schematic and their shapes are not intended to exclusively illustrate the precise shape of a region of a device and are not intended to limit the scope of the disclosure. Common elements between figures may be shown herein with common element numbers and may not be subsequently re-described.

Solid state lighting devices according to certain embodiments are configured to provide aggregate emissions that include emissions from solid state light emitters and emissions that are reflected by preferential reflector structures. Preferential reflectors have non-uniform spectral reflectivities that preferentially reflect certain wavelengths of emissions received from solid state light emitters. One or more preferential reflectors may be utilized in solid state lighting devices incorporating solid state light emitters of different correlated color temperature (CCT) values and one or more preferential reflectors configured to shift CCT values of aggregate emissions of such solid state lighting devices. Such arrangements may provide solid state lighting devices with reduced complexity and reduced cost while providing aggregate emissions that are tunable between multiple CCT values along or near a black body locus (BBL).

The terms "solid state light emitter" or "solid state emitter" (which may be qualified as being "electrically activated") may include a light-emitting diode (LED), laser diode, organic LED, and/or other semiconductor device which includes one or more semiconductor layers, which may include silicon (Si), silicon carbide (SiC), gallium nitride (GaN) and/or other semiconductor materials, a substrate which may include sapphire, Si, SiC and/or other microelectronic substrates, and one or more contact layers which may include metal and/or other conductive materials. Solid state light emitters as disclosed herein may also include an LED package or an LED component.

Solid state light emitters according to embodiments of the present disclosure may include, but are not limited to, Group III-V nitride based LED chips or laser chips fabricated on a Si, SiC, sapphire, or Group III-V nitride growth substrates. Other material systems for solid state light emitters may include SiC, organic semiconductor materials, and other Group III-V systems such as gallium phosphide (GaP), gallium arsenide (GaAs), and related compounds. Such LEDs and/or lasers may optionally be configured to operate such that light emission occurs through the substrate in a so-called "flip chip" orientation. Such LED and/or laser chips may also be devoid of growth substrates (e.g., following growth substrate removal).

LED chips useable with lighting devices as disclosed herein may include horizontal devices (with both electrical contacts on a same side of the LED) and/or vertical devices (with electrical contacts on opposite sides of the LED). A horizontal device (with or without the growth substrate), for example, may be flip chip bonded (e.g., using solder) to a carrier substrate or printed circuit board (PCB), or wire bonded. A vertical device (without or without the growth substrate) may have a first terminal solder bonded to a carrier substrate, mounting pad, or PCB, and have a second terminal wire bonded to the carrier substrate, electrical element, or PCB. Although certain embodiments shown in the figures may be appropriate for use with vertical LEDs, it is to be appreciated that the present disclosure is not so limited, such that any combination of one or more of the following LED configurations may be used in a single solid state light emitting device: horizontal LED chips, horizontal flip LED chips, vertical LED chips, vertical flip LED chips, and/or combinations thereof, with conventional or reverse polarity.

Solid state light emitters may be used individually or in groups to emit one or more beams to stimulate emissions of one or more lumiphoric materials to generate light at one or more peak wavelengths, or of at least one desired perceived color (including combinations of colors that may be perceived as white). Lumiphoric materials as described herein may be or include one or more of a phosphor, a scintillator, a lumiphoric ink, a quantum dot material, a day glow tape, and the like. Lumiphoric materials may be provided by any suitable means, for example, direct coating on one or more surfaces of an LED, dispersal in an encapsulant material configured to cover one or more LEDs, and/or coating on one or more optical or support elements (e.g., by powder coating, inkjet printing, or the like). In certain embodiments, lumiphoric materials may be downconverting or upconverting, and combinations of both downconverting and upconverting materials may be provided. In certain embodiments, multiple different (e.g., compositionally different) lumiphoric materials arranged to produce different peak wavelengths may be arranged to receive emissions from one or more LED chips. Lumiphoric materials may be provided in the form of particles, films, or sheets.

Inclusion of lumiphoric (also called luminescent) materials in lighting devices as described herein may be accomplished by any suitable means, including: direct coating on solid state emitters, dispersal in encapsulant materials arranged to cover solid state emitters; coating on lumiphor support elements (e.g., by powder coating, inkjet printing, or the like); incorporation into diffusers or lenses; and the like. Other materials, such as light-scattering elements (e.g., particles) and/or index-matching materials, may be associated with a lumiphoric material-containing element or surface. One or more lumiphoric materials useable in devices as described herein may be downconverting or upconverting, or can include a combination of both types.

In certain embodiments, at least one lumiphoric material may be spatially segregated ("remote") from and arranged to receive emissions from at least one electrically activated solid state emitter, with such spatial separation reducing thermal coupling between a solid state emitter and lumiphoric material. In certain embodiments, a spatially segregated lumiphor may be arranged to fully cover one or more electrically activated emitters of a lighting device. In certain embodiments, a spatially segregated lumiphor may be arranged to cover only a portion or subset of one or more electrically activated emitters.

In certain embodiments, at least one lumiphoric material may be arranged with a substantially constant thickness and/or concentration relative to different electrically activated emitters. In certain embodiments, one or more lumiphoric materials may be arranged with presence, thickness, and/or concentration that vary relative to different emitters. Multiple lumiphors (e.g., lumiphors of different compositions) may be applied with different concentrations or thicknesses relative to different electrically activated emitters. In one embodiment, lumiphor presence, composition, thickness and/or concentration may vary relative to multiple electrically activated emitters. In certain embodiments, at least one lumiphoric material may be applied to a solid state emitter or a lumiphoric material support surface by patterning, such may be aided by one or more masks.

Various substrates may be used as mounting elements on which, in which, or over which multiple solid state light emitters (e.g., emitter chips) may be arranged or supported (e.g., mounted). Exemplary substrates include PCBs (including but not limited to metal core PCBs (MCPCBs), flexible circuit boards, dielectric laminates, and the like) having electrical traces arranged on one or multiple surfaces thereof. A substrate, mounting plate, or other support element may include a PCB, a MCPCB, a flexible PCB, a dielectric laminate (e.g., FR-4 boards as known in the art) or any suitable substrate for mounting LED chips and/or LED packages. In certain embodiments, at least a portion of a substrate may include a dielectric material to provide desired electrical isolation between electrical traces or components of multiple LED sets. In certain embodiments, a substrate can comprise ceramic such as alumina, aluminum nitride (AlN), SiC, or a polymeric material such as polyimide, polyester, etc.

In certain embodiments, one or more LED components can include one or more "chip-on-board" (COB) LED chips and/or packaged LED chips that can be electrically coupled or connected in series or parallel with one another and mounted on a portion of a substrate. In certain embodiments, COB LED chips can be mounted directly on portions of substrate without the need for additional packaging.

In certain embodiments, multiple solid state emitters or groups of solid state emitters may be arranged on a single substrate, submount, or mounting element. Current and/or duty cycle of different solid state emitters or groups of solid state emitters having different color points may be set (e.g., pre-set) or adjusted to achieve a mixture of light having an aggregate color point of a desired character. In certain embodiments, some emitters of the multiple solid state emitters or groups of solid state emitters may include or otherwise be arranged to stimulate emissions of one or more lumiphoric materials. In certain embodiments, all emitters of the multiple solid state emitters or groups of solid state emitters may include or otherwise be arranged to stimulate emissions of one or more lumiphoric materials. In certain embodiments, a lighting device may be devoid of any non-lumiphor-converted blue solid state emitter (i.e., the lighting device may be devoid of any electrically activated solid state light emitter arranged to generate emissions that have dominant wavelengths in a range of from 430 nanometers (nm) to 480 nm and that exit the lighting device without passage through a layer or region comprising a lumiphoric material).

In certain embodiments, one or more solid state emitters comprise solid state emitter packages, or LED packages. A solid state emitter package may include at least one solid state emitter chip (or multiple solid state emitter chips) that is enclosed with packaging elements to provide environmental protection, mechanical protection, color selection, and/or light focusing utility, as well as electrical leads, contacts, and/or traces enabling electrical connection to an external circuit. One or more emitter chips may be arranged to stimulate one or more lumiphoric materials, which may be coated on, arranged over, or otherwise disposed in light-receiving relationship to one or more solid state emitters. At least one lumiphoric material may be arranged to receive emissions of at least some emitters of a plurality of solid state light emitters and responsively emit lumiphor emissions. A lens and/or encapsulant material, optionally including lumiphoric material, may be disposed over solid state emitters, lumiphoric materials, and/or lumiphor-containing layers in a solid state emitter package. As used herein, LED packages may include arrangements that include one or more of package submounts, electrical connections, light-altering materials, reflective materials, encapsulants, lenses, optics, and lumiphoric materials on or supporting one or more LED chips.

In certain embodiments, a light emitting apparatus as disclosed herein (whether or not including one or more LED packages) may include at least one of the following items arranged to receive light from multiple LEDs: a single leadframe arranged to conduct electrical power to a plurality of electrically activated solid state light emitters; a single reflector arranged to reflect at least a portion of light emanating from a plurality of electrically activated solid state light emitters; a single submount or mounting element supporting a plurality of electrically activated solid state light emitters; a single lens arranged to transmit at least a portion of light emanating from a plurality of electrically activated solid state light emitters; and a single diffuser arranged to diffuse at least a portion of light emanating from a plurality of electrically activated solid state light emitters. In certain embodiments, a light emitting apparatus including multiple LEDs may include at least one of the following items arranged to receive light from multiple LEDs: multiple lenses; multiple optical elements; and multiple reflectors. Examples of optical elements include, but are not limited to elements arranged to affect light mixing, focusing, collimation, dispersion, and/or beam shaping.

In certain embodiments, a package may include a molded lens arranged to transmit light emitted by multiple LEDs. As known in the art, a mold including one or more cavities can be arranged over a substrate (or a panel of substrate material, from which multiple substrates may be singulated by sawing or other means) and LED chips arranged thereon, with the mold comprising a lens material and/or encapsulant in liquid form. In certain embodiments, a lens may be formed of liquid curable silicone, and LED chips may be embedded in liquid silicone, which is subsequently cured to form one or more lenses. Alternatively, a lens may be pre-molded and then affixed (e.g., with adhesives, thermal bonding, or any other suitable joining method) to a subassembly including a substrate to which or over which with multiple LED chips are mounted.

In certain embodiments, a solid state lighting device (e.g., package) may include a reflector cup defining a cavity, at least one solid state emitter arranged within the cavity, and an encapsulant material arranged within the cavity. In certain embodiments, at least one solid state emitter may be arranged over a substrate and at least partially surrounded by a boundary wall (optionally embodying at least one dispensed dam material laterally spaced from the emitter(s)), with an encapsulant material arranged over the emitter(s) and in contact with the at least one boundary wall.

Various devices disclosed herein may include multiple solid state emitters (e.g., LEDs) of the same or different dominant colors, or of the same or different peak wavelengths. In certain embodiments, a solid state light emitting device may include at least three colors such as red, green, and blue emitters, which may include solid state light emitters devoid of phosphors, or may include phosphors (e.g., in combination with ultraviolet (UV) and/or blue emitters) to generate one or more of the red, green, and blue colors. Other combinations of output colors may be provided. In certain embodiments, a solid state light emitting device may include at least two colors.

The expressions "lighting device," "light emitting device," and "light emitting apparatus" as used herein are not limited, except that such elements are capable of emitting light. That is, a lighting device or light emitting apparatus can be a device which illuminates an area or volume, e.g., any indoor area or volume, any outdoor area or volume. Lighting devices as disclosed herein may include troffers, downlights, suspending lighting, high-bay, low-bay, light bulbs, bulb replacements (e.g., for replacing AC incandescent lights, low voltage lights, fluorescent lights, etc.), outdoor lighting, street lighting, security lighting, exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting devices. In certain embodiments, lighting devices or light emitting apparatuses as disclosed herein may be self-ballasted. In certain embodiments, a light emitting apparatus may be embodied in a light fixture.

Color reproduction can commonly be measured using color rendering index (CRI) or average color rendering index (CRI Ra). To calculate CRI, the color appearance of fourteen reflective samples is simulated when illuminated by a reference radiator (illuminant) and a test source. The CRI Ra is a modified average utilizing the first eight indices, all of which have low to moderate chromatic saturation. (R9 is one of six saturated test colors not used in calculating CRI, with R9 embodying a large red content.) The CRI and CRI Ra are used to determine how closely an artificial light source matches the color rendering of a natural light source at the same CCT. Daylight has a high CRI Ra (approximately 100), with incandescent bulbs also being relatively close (CRI Ra greater than 95), and fluorescent lighting being less accurate (with typical CRI Ra values of approximately 70-80).

The reference spectra used in CRI calculations are chosen as ideal illumination sources defined in terms of their color temperature. As a heated object becomes incandescent, it first glows reddish, then yellowish, then white, and finally bluish. Thus, apparent colors of incandescing materials are directly related to their actual temperature (in Kelvin (K)). Practical materials that incandesce are said to have CCT values that are directly related to color temperatures of blackbody sources.

Figure 1A:
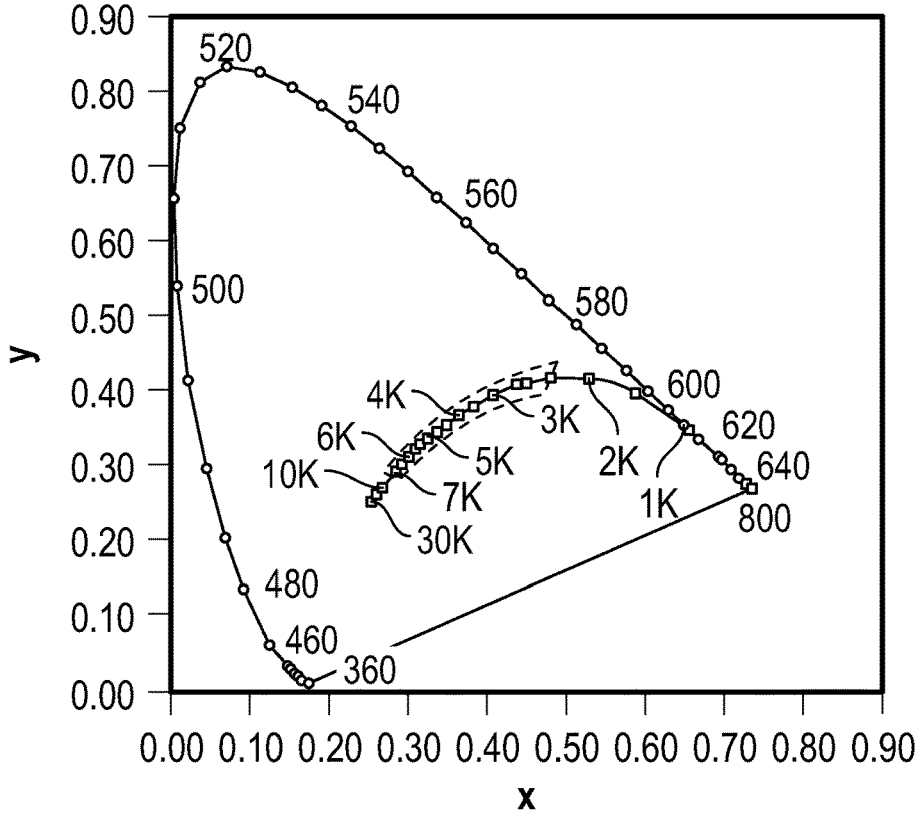
FIG. 1A (Related Art)
FIG. 1A is a representation of the 1931 Commission International de l'Eclairage (CIE) Chromaticity Diagram with addition of the blackbody locus (BBL) and labeled points identifying various correlated color temperature (CCT) values on the BBL.

Aspects disclosed herein may be better understood with reference to the 1931 Commission International de l'Eclairage (CIE) Chromaticity Diagram, which is well-known and of which a copy is reproduced in FIG. 1A. The 1931 CIE Chromaticity Diagram maps out the human color perception in terms of two CIE color coordinate parameters x and y (sometimes indicated as CCx and CCy). The spectral colors are distributed around the edge of the outlined space, which includes all of the hues perceived by the human eye. The outer boundary lines represents maximum saturation for the spectral colors and may be referred to as a spectrum locus of the 1931 CIE Chromaticity Diagram. The chromaticity coordinates (i.e., color points) that lie along the BBL (also known as the Planckian locus) obey Planck's equation: $E(\lambda)=A\lambda-5/(eB/T-1)$, where E is the emission intensity, A is the emission wavelength, T is the color temperature of the blackbody, and A and B are constants. Color coordinates that lie on or near the BBL (which embodies a curved line emanating from the right lower corner) yield pleasing white light to a human observer. The 1931 CIE Diagram includes temperature listings along the BBL, with these temperature listings showing the color path of a blackbody radiator that is caused to increase to such temperatures. As a heated object becomes incandescent, it first glows reddish, then yellowish, then white, and finally bluish. This occurs because the wavelength associated with the peak radiation of the blackbody radiator becomes progressively shorter with increased temperature, consistent with the Wien Displacement Law. Illuminants which produce light that is on or near the BBL can thus be described in terms of their color temperature. A white light area proximate to (i.e., within approximately a MacAdam eight-step ellipse of) the BBL and between 2,500 K and 10,000 K, is shown in FIG. 1A, although other color temperatures may also be referred to as white light in certain applications.

The term "white light" or "whiteness" does not clearly cover the full range of colors along the BBL since it is apparent that a candle flame and other incandescent sources appear yellowish, i.e., not completely white. Accordingly, the color of illumination may be better defined in terms of CCT and in terms of its proximity to the BBL. The pleasantness and quality of white illumination decreases rapidly if the chromaticity point of the illumination source deviates from the BBL by a distance of greater than 0.01 in the x, y chromaticity system. This corresponds to the distance of about a MacAdam four-step ellipse, a standard employed by the lighting industry. A lighting device emitting light having color coordinates that are within a MacAdam four-step ellipse of the BBL and that has a CRI Ra greater than 80 is generally acceptable as a white light for general illumination purposes. A lighting device emitting light having color coordinates within a MacAdam seven- or eight-step ellipse of the BBL and that has a CRI Ra greater than 70 is used as the minimum standards for many other white lighting devices including compact fluorescent and solid-state lighting devices.

Figure 1B:
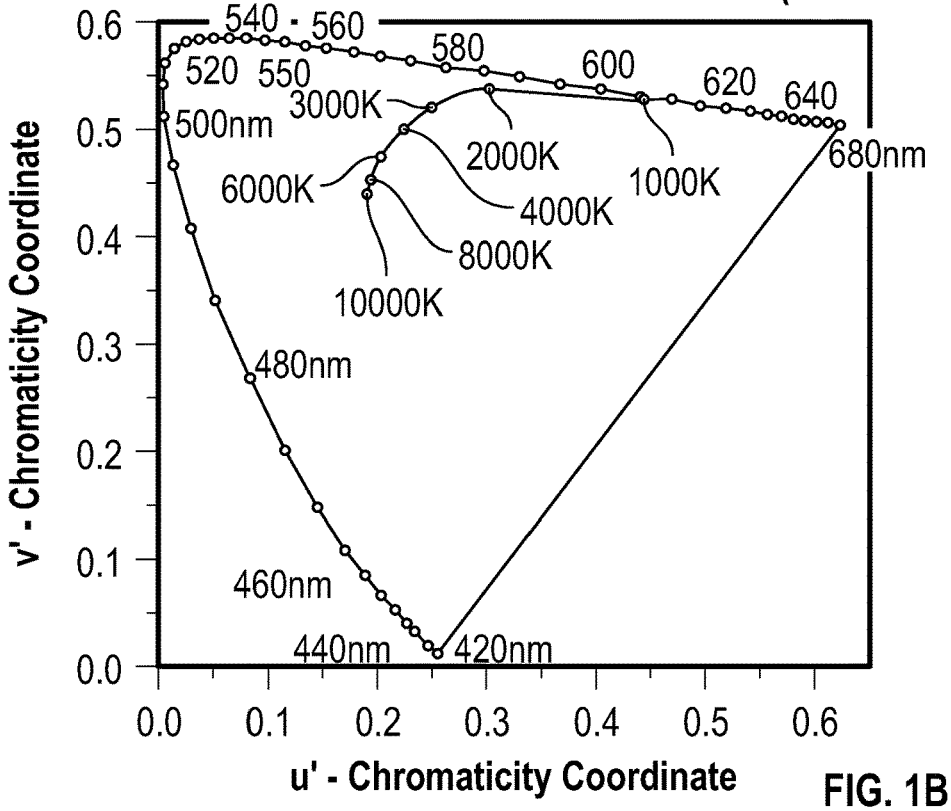
FIG. 1B (Related Art)
FIG. 1B is a representation of the 1976 CIE Chromaticity Diagram with addition of the blackbody locus and labeled points identifying various CCT values thereon.

The 1976 CIE Chromaticity Diagram, also well-known and readily available to those of ordinary skill in the art, maps human color perception in terms of CIE parameters u' and v'. The 1976 CIE Chromaticity Diagram (also known as the (u'v') chromaticity diagram) is reproduced at FIG. 1B. The spectral colors are distributed around the edge of the outlined space, which includes all of the hues perceived by the human eye. The boundary line represents maximum saturation for the spectral colors. The 1976 CIE Chromaticity Diagram is similar to the 1931 Diagram, except that the 1976 Diagram has been modified such that similar distances on the Diagram represent similar perceived differences in color. Since similar distances on the 1976 Diagram represent similar perceived differences in color, deviation from a point on the 1976 Diagram can be expressed in terms of the coordinates u' and v', e.g., distance from the point=$(\Delta u'2+\Delta v'2)'½$, and the hues defined by a locus of points that are each a common distance from a specified hue consist of hues that would each be perceived as differing from the specified hue to a common extent. Du'v' is a metric that quantifies the distance between a color point and a point on the BBL having the same CCT in the u', v' coordinate system. A negative Du'v' value indicates a color point below the BBL and a positive Du'v' value indicates a point above the BBL. Du'v' may also be used to quantify the absolute distance between two separate color points. In the u', v' coordinate system, a MacAdam four-step ellipse may be essentially the same as a Du'v' of 0.004. In certain applications, Du'v' can be a preferred way to represent absolute color differences between two color points or between a color point and a point on the BBL having the same CCT.

Figure 2:
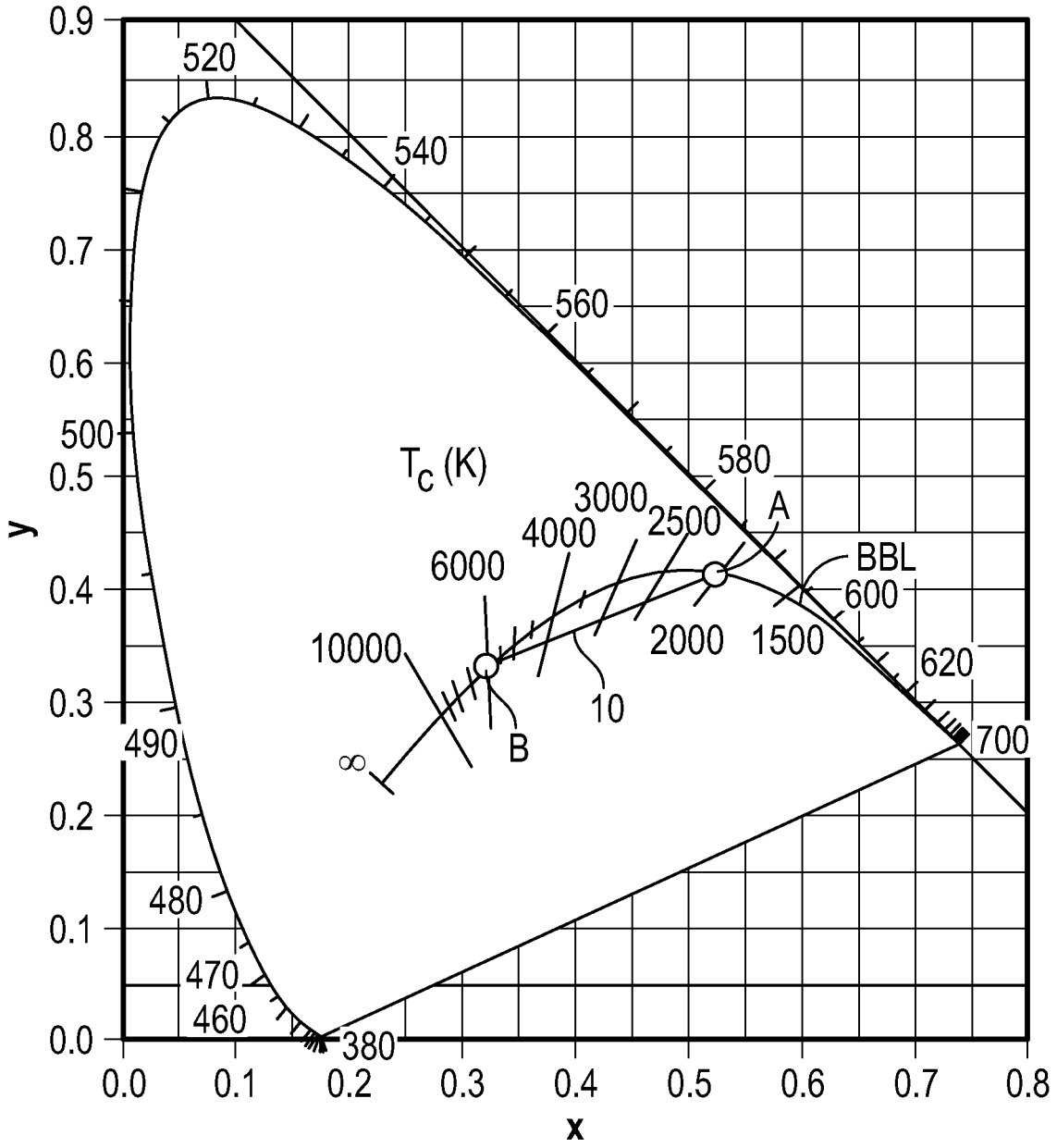
FIG. 2 (Related Art)
FIG. 2 is a representation of the 1931 CIE Chromaticity Diagram showing the BBL and hash marks indicating CCT values thereon, overlaid with two color points and an emission line that is drawn therebetween.

FIG. 2 is the 1931 CIE Chromaticity Diagram showing the BBL, overlaid with two color points A and B and an emission line 10 that is drawn therebetween. Each color point A and B encompasses a CCT value that may be obtained from emissions of one or more solid state emitters (optionally including one or more lumiphoric materials) that are provided in a solid state lighting device. By way of example, the color point A represents emissions from at least one solid state emitter and at least one corresponding lumiphoric material configured to provide emissions with a CCT of 2000 K, and the color point B represents emissions from at least one solid state emitter and at least one corresponding lumiphoric material configured to provide emissions with a CCT of 6000 K. The emission line 10 is illustrated as a straight line that connects the color points A and B. When mixed, a combined light output that includes emissions of first and second solid state emitters having respective color points A and B will accordingly have a CCT value along the emission line 10, which is notably off of the BBL, particularly along central portions thereof. In this regard, solid state lighting devices having solid state emitters configured to provide differing CCT values may have overall emission values defined at perceivable distances from the BBL. For tunable solid state lighting devices where independent drive signals may be provided to adjust or tune amount of emissions corresponding to one or more of the color points A and B, CCT values of aggregate emissions may be tuned to values anywhere along the emission line 10.

FIG. 3A is the 1931 CIE Chromaticity Diagram showing the BBL and spectrum locus, overlaid with three color points A-C and three corresponding emission lines 10-1 to 10-3 that define boundaries of a two-dimensional color region. By way of example, the color points A and B respectively represent first and second CCT values of 2000 K and 6000 K as described for FIG. 2 and the color point C represents a peak wavelength of about 555 nm along the spectrum locus. In this manner, combined emissions including contributions from the three color points A-C, may be defined within the two-dimensional color region bounded by the emission lines 10-1 to 10-3 and inclusive of the BBL. As such, tunable solid state devices may be provided with overall emissions that are tunable between multiple CCT values along or near the BBL. According to embodiments disclosed herein, color point C may be provided by way of a preferential reflector that is configured with a non-uniform spectral reflectivity exhibiting a peak reflectively for color points above the BBL and above the color points A and B on the 1931 CIE Chromaticity Diagram. In the example illustrated in FIG. 3A, the preferential reflector may be configured with a non-uniform spectral reflectivity exhibiting a peak reflectivity of about 555 nm along the spectrum locus. Accordingly, an exemplary solid state lighting device may comprise at least one first solid state emitter (e.g., a first LED chip) and a corresponding first lumiphoric material configured to provide emissions having color point A, at least one second solid state emitter (e.g., a second LED chip) and a corresponding second lumiphoric material configured to provide emissions having color point B, and a preferential reflector arranged to receive at least a portion of the emissions of the first and second solid state emitters, and preferentially reflect wavelength portions of these emissions that correspond to color point C. By this preferential reflection, portions of other spectral emissions of the first and second solid state emitters that are received by the preferential reflector may be preferentially absorbed or otherwise lost to internal reflections, thereby increasing relative amounts of light corresponding to color point C in overall light emissions from the solid state lighting device. In this regard, combined or aggregate emissions of the first and second solid state emitters having respective color points A and B that would otherwise fall along the emission line 10-1 may be shifted to along the BBL as indicated by combined emission line 12 by contributions from color point C.

In certain embodiments, the color points A and B may be configured to differ from one another by at least 100 K, or by at least 300 K, or by at least 500 K, or by at least 1000 K, or by at least 2000 K, or by at least 3000 K or more. In certain embodiments, the color points A and B may fall in different parallelograms as defined by the American National Standards Institute (ANSI) C78.377-2008 LED binning standard where some neighboring bins are as close as 300 K apart.

In certain embodiments, a preferential reflector with a non-uniform spectral reflectivity may also be referred to as a bandpass reflector (e.g., to preferentially absorb wavelengths above and below an intermediate wavelength range that is reflected). In certain embodiments, a preferential reflector with a non-uniform spectral reflectivity may also be referred to as a high-pass reflector (e.g., to preferentially absorb wavelengths below a certain wavelength range and preferentially reflect wavelengths above a certain wavelength range). In certain embodiments, a preferential reflector with a non-uniform spectral reflectivity may also be referred to as a low-pass reflector (e.g., to preferentially reflect wavelengths below a certain wavelength range and preferentially absorb wavelengths above a certain wavelength range)

In certain embodiments, solid state lighting devices disclosed herein are tunable between multiple CCT values along or near the BBL while being devoid of any solid state light emitters that are configured to provide emissions other than a first CCT and a second CCT. In certain applications, a group of solid state light emitters that are configured to target the first CCT or the second CCT may have individual solid state light emitters with slight variations in CCT values. As such, the first CCT value and the second CCT value may each comprise a 500 K range of CCT values. In this regard, solid state lighting devices according to certain embodiments are tunable between multiple CCT values along or near the BBL while being devoid of any solid state light emitters that are configured to provide emissions having a third CCT value that differs by more than 300 K from both of the first CCT and the second CCT.

Conventional solid state lighting devices may be configured for operation along the BBL and within a two-dimensional region defined by boundaries of the emission lines 10-1 to 10-3 shown in FIG. 3A by providing a third solid state emitter that may include a third lumiphoric material. In this manner, such solid state lighting devices typically include three different independently adjustable solid state emitters or solid state emitter groups configured to provide three different colors to provide tunability. Embodiments as disclosed herein provide solid state lighting devices that are tunable between multiple CCT values along or near the BBL with only two solid state emitters or groups thereof that are configured to provide different emission color points, thereby reducing costs and complexity associated with a third electrically active solid state emitter and a third lumiphoric material.

While FIG. 3A illustrates an embodiment where the preferential reflector is configured to preferentially reflect wavelength portions that correspond to the color point C, embodiments disclosed herein are not limited to a single color point. In certain embodiments, the preferential reflector may comprise a non-wavelength-converting material having a non-uniform spectral reflectivity exhibiting a peak reflectivity with a color point on the 1931 CIE Chromaticity Diagram including x, y coordinates that define a point on or within a closed shape or two-dimensional color region that defines a range of color points between the BBL and the spectrum locus of the 1931 CIE Chromaticity Diagram.

FIG. 3B is the 1931 CIE Chromaticity Diagram showing the BBL and spectrum locus, overlaid with four color points D-G that define boundaries of a closed two-dimensional color region. By way of example, the color point D represents an x, y coordinate of (0.2806, 0.2883) that corresponds to about 10000 K along the BBL, and the color point E represents an x, y coordinate of (0.5267, 0.4133) that corresponds to about 2000 K along the BBL. Color point F represents an x, y coordinate of (0.0139, 0.7502) that corresponds to about 510 nm along the spectrum locus and color point G represents an x, y coordinate of (0.5125, 0.4866) that corresponds to about 580 nm along the spectrum locus. In certain embodiments, the color points D and E represent first and second solid state light emitters configured to produce emissions having different CCT values. A preferential reflector may be arranged to receive at least a portion of emissions corresponding to the color points D and E. In certain embodiments, the preferential reflector comprises a non-wavelength-converting material having a non-uniform spectral reflectivity exhibiting a peak reflectivity with a color point on the 1931 CIE Chromaticity Diagram including x, y coordinates that define a point on or within a closed shape bounded by a first line having x, y endpoint coordinates of color point D and color point F, a curve corresponding to a portion of a spectrum locus of the 1931 CIE Chromaticity Diagram having x, y endpoint coordinates of color point F and color point G, a second line having x, y endpoint coordinates of color point E and color point G, and a curve corresponding to a portion of a blackbody locus of the 1931 CIE Chromaticity Diagram having x, y endpoint coordinates of color point D and color point E. In certain embodiments, a preferential reflector may be configured with a non-uniform spectral reflectivity exhibiting a peak reflectivity for wavelengths along the spectrum locus within a range of 510 nm to 580 nm. For such embodiments, the peak reflectivity for all color points may fall either on the spectrum locus or off of the spectrum locus.

FIG. 4 is a top view schematic illustration of a solid state lighting device 14A according to one embodiment, including first and second solid state light emitters 16-1, 16-2 and a preferential reflector 18A having a non-uniform spectral reflectivity. In certain embodiments, the solid state emitters 16-1, 16-2 comprise packaged LED devices or LED packages. The first and second solid state light emitters 16-1, 16-2 and the preferential reflector 18A may be arranged on a submount 20. Depending on the application, the submount 20 may comprise a PCB on which the solid state light emitters 16-1, 16-2 and the preferential reflector 18A are mounted or otherwise supported. In other embodiments, the submount 20 may comprise a housing for a lighting fixture. The first and second solid state light emitters 16-1, 16-2 may be respectively configured to provide emissions corresponding to the color points A and B as illustrated in FIG. 3A. The first solid state light emitter 16-1 may be configured to produce first emissions having a first CCT value, and the second solid state light emitter 16-2 may be configured to produce second emissions having a second CCT. The first and second emissions may be configured along or proximate to the BBL and may be configured to provide corresponding first and second CCT values that differ from one another by at least 100 K, or by at least 300 K, or by at least 500 K, or by at least 1000 K, or by at least 2000 K, or by at least 3000 K or more. For color tunable applications, each of the first and second solid state light emitters 16-1, 16-2 may be individually controllable with separate electrical connections and one or more control elements (not shown).

As illustrated in FIG. 4, the preferential reflector 18A is arranged on a portion of the submount 20 that is proximate or adjacent to the first and second solid state light emitters 16-1, 16-2. The preferential reflector 18A is arranged to receive at least a portion of each of the first and second emissions from the solid state light emitters 16-1, 16-2 and preferentially reflect certain wavelengths of the first and second emissions. The preferential reflector 18A is configured to have a non-uniform spectral reflectivity exhibiting a peak reflectivity at a wavelength range or color point that differs from the color points of the combined first and second emissions. In certain embodiments, the preferential reflector 18A comprises a non-wavelength-converting material having a non-uniform spectral reflectivity. In this regard, the preferential reflector 18A is not configured for wavelength conversion of any of the first and second emissions. In certain embodiment, the preferential reflector 18A may comprise at least one pigment material that comprises a color corresponding to a wavelength within the peak reflectivity range, such as one or more of yellow, green, and yellow/green, among others. At least one tinted or colored pigment material may be provided or embedded within a binder material such as silicone, or at least one tinted or colored pigment material may be applied to a surface of a support material that is subsequently provided on the submount 20. In certain embodiments, the preferential reflector 18A comprises a tinted or colored adhesive tape that includes the at least one pigment material. In other embodiments, the preferential reflector 18A may comprise a tinted or colored solder mask material having the at least one pigment material. In still further embodiments, the preferential reflector 18A may comprise a tinted or colored paint having the at least one pigment material that is applied to the submount 20. The preferential reflector 18A provides lower costs, easier application, and reduced device complexity as compared with conventional color tuning techniques such as adding additional solid state emitters or lumiphoric materials.

In certain embodiments, the preferential reflector 18A is configured to exhibit a peak reflectivity for color points above the BBL (i.e., as shown in a chromaticity diagram) and above the color points corresponding to the first and second solid state light emitters 16-1, 16-2. For example, the preferential reflector 18A may be configured with a peak reflectivity within a range of 510 nm to 580 nm as illustrated by the color point C of FIG. 3A. In this manner, aggregate emissions for the solid state lighting device 14A may include portions of the first and second emissions that are not received by or interact with the preferential reflector 18A and portions of the first and second emissions that are reflected by the preferential reflector 18A. The portions of the aggregate emissions that are reflected by the preferential reflector 18A are configured with higher relative amounts of wavelengths of light corresponding to peak reflectivity ranges of the preferential reflector 18A. By increasing the relative amounts of wavelengths of light that corresponds to the peak reflectivity ranges, the color point of the aggregate emissions of the solid state lighting device 14A may be shifted. In certain embodiments, the color point of the aggregate emissions of the solid state lighting device 14A may be shifted closer to or along the BBL. For tunable applications, the solid state lighting device 14A may be tunable between multiple CCT values along or near the BBL for any color point between the first and second CCT values of the first and second solid state light emitters 16-1, 16-2. In certain embodiments, the preferential reflector 18A may be configured along only a portion of the submount 20 that is uncovered by the solid state light emitters 16-1, 16-2. The amount of surface area occupied by the preferential reflector 18A may be tailored for each application depending on a desired or targeted shift for the aggregate emissions. In certain embodiments, portions of the submount 20 that are uncovered by both of the solid state light emitters 16-1, 16-2 and the preferential reflector 18A may be configured with a conventional reflector or a reflective surface configured to more uniformly reflect the first and second emissions. For example, such surfaces may be covered with a white reflective material, such as a white solder mask material.

FIGS. 5-7 are top view illustrations of solid state lighting devices including alternative arrangements of the first and second solid state light emitters 16-1, 16-2 and at least one preferential reflector. In FIG. 5, a plurality of first solid state emitters 16-1 and a plurality of second solid state emitters 16-2 are arranged on the submount 20, and the preferential reflector 18B is provided as an elongated strip that extends between different ones of multiple paired first and second light emitters 16-1, 16-2. In certain embodiments, the first and second solid state light emitters 16-1, 16-2 may be arranged in an alternating manner along a plurality of columns and/or in an alternating manner within each column of the plurality of columns to promote color mixing and uniformity of aggregate emissions of the solid state lighting device 14B. While FIG. 5 illustrates two columns for illustrative purposes, the solid state lighting device 14B may comprise any number of columns of the solid state light emitters 16-1, 16-2 with one or more of the preferential reflectors 18B arranged between one or more of the columns. In other embodiments, the first and second solid state light emitters 16-1, 16-2 may be provided in other arrangements, such as one or more of circular, hexagonal, rectangular and various other geometric arrays with one or more preferential reflectors 18B extending between different ones of the solid state light emitters 16-1, 16-2. In FIG. 6, the solid state lighting device 14C includes a preferential reflector 18C arranged around one or more peripheral portions of the solid state light emitters 16-1, 16-2. For example, a plurality of preferential reflectors 18C are arranged along two sides around a periphery of an array formed by multiple pairs of the first and second solid state light emitters 16-1, 16-2. In FIG. 7, the solid state lighting device 14D includes a continuous preferential reflector 18D is arranged around an entire periphery of the array formed by the first and second solid state light emitters 16-1, 16-2.

FIG. 8 is a cross-sectional view of a solid state lighting device 14E for embodiments in which one or more preferential reflectors 18E are arranged about a periphery of the first and second solid state light emitters 16-1, 16-2. As illustrated, the one or more preferential reflectors 18E may be attached or otherwise provided on a first surface 20' of the submount 20 in a position adjacent to one or more of the first and second solid state emitters 16-1, 16-2. In certain embodiments, a height or thickness of the one or more preferential reflectors 18E is less than a height or thickness of the solid state emitters 16-1, 16-2. In this manner, the one or more preferential reflectors 18E are arranged to receive only a portion of the emissions from the solid state emitters 16-1, 16-2. Such an arrangement may be advantageous for applications in which a relatively small shift in the aggregate emissions of the solid state lighting device 14E is desired. For example, in certain embodiments, the aggregate emissions may be shifted relative to the BBL by a Du'v' value in a range of between 0 and 0.004, or in a range of between 0 and 0.003, or in a range of between 0 and 0.002. In other embodiments, aggregate emissions may be shifted relative to the BBL by higher Du'v' values depending on the application.

FIGS. 9-11 are cross-sectional views of solid state lighting devices including alternative arrangements of one or more preferential reflectors. In FIG. 9, a solid state lighting device 14F includes separate electrical connections 22 for each of the solid state emitters 16-1, 16-2. As illustrated, a plurality of the electrical connections 22 may be provided on the submount 20 with respective pairs of electrical connections 22 corresponding to anode-cathode pairs that are registered with each of the solid state emitters 16-1, 16-2. The electrical connections 22 may comprise one or more electrically conductive traces and/or bondpads. For surface mount configurations of the solid state emitters 16-1, 16-2, the solid state emitters 16-1, 16-2 may be bonded to corresponding pairs of the electrical connections 22. In other mounting configurations, wire bonds may be provided between the solid state emitters 16-1, 16-2 and the electrical connections 22. A solder mask material 23 may be applied on any of the first surface 20' of the submount 20 that is uncovered by the electrical connections 22. In certain embodiments, the solder mask material 23 may additionally cover portions of the electrical connections that extend away from the solid state emitters 16-1, 16-2. In FIG. 9, one or more of the preferential reflectors 18F are arranged on portions of the solder mask material 23. Depending on the configuration of the electrical connections 22, the one or more preferential reflectors 18 may also extend over portions of one or more of the electrical connections 22.

In FIG. 10, the electrical connections 22 and one or more preferential reflectors 18G are provided on the first surface 20' before application of the solder mask material 23. In this regard, the solid state lighting device 14G may be devoid of the solder mask material 23 between the one or more preferential reflectors 18G and the submount 20. In FIG. 11, the preferential reflector 18H is provided as, or incorporated within, the solder mask material 23 of the solid state lighting device 14H. For example, the solder mask material 23 may comprise colored particles or pigments within the solder mask material 23 such that the solder mask material 23 is configured to have a non-uniform spectral reflectivity exhibiting a peak reflectivity in a desired wavelength range. In certain embodiments, the preferential reflector 18H may be arranged along the entire solder mask material 23, while in other embodiments, only certain portions of the solder mask material 23 comprise a preferential reflector 18H. By incorporating the preferential reflector 18H within the solder mask material 23, the solid state emitters 16-1, 16-2 may be mounted along a horizontal plane that is above the preferential reflector 18H. In this manner, emissions that are received by the preferential reflector 18H from the solid state emitters 16-1, 16-2 may be reduced from the embodiments of FIGS. 8 and 9, thereby providing different shifts in the aggregate emissions.

FIGS. 12-14 are cross-sectional views of solid state lighting devices illustrating various arrangements of one or more preferential reflectors relative to optics of such solid state lighting devices. In FIG. 12, a solid state lighting device 24A includes the solid state light emitters 16-1, 16-2 that are provided on the submount 20 as previously described. In certain embodiments, the submount 20 may comprise a portion of a housing of a lighting fixture or an intermediate support that is mounted to a housing of a lighting fixture. As illustrated, the optic 26 may be provided over the solid state light emitters 16-1, 16-2. The optic 26 may be a one-piece member or it may be constructed of multiple pieces assembled to form a lens. The optic 26 may be made of plastic, such as extruded plastic. In certain embodiments, the optic 26 is configured to be light-transmissive and diffusive to improve color mixing and uniformity of aggregate emissions from the solid state lighting device 24A. In certain embodiments, the optic 26 may form a lens. The optic 26 may form a curved shape as illustrated in FIG. 12, or the optic 26 may alternatively form a generally planar shape. In certain embodiments, space within the solid state lighting device 24A that is at least partially enclosed by and/or defined by the optic 26 and the submount 20 or housing may be referred to as a mixing chamber 28. In certain embodiments, the solid state light emitters 16-1, 16-2 are arranged within the mixing chamber 28 that is defined between the optic 26 and portions of the submount 20 or housing of a corresponding lighting fixture.

As illustrated, one or more preferential reflectors 18I are provided on the submount 20 such that the one or more preferential reflectors 18I are arranged between the optic 26 and the submount 20, or within the mixing chamber 28. Such an arrangement permits aggregate emissions from the solid state light emitters 16-1, 16-2, including those that may be reflected by the one or more preferential reflectors 18I, to be mixed and/or diffused by the optic 26 for improved emission uniformity. Enclosing the preferential reflectors 18I with the optic 26 may provide the additional benefit of at least partially obscuring the preferential reflectors 18I from view when the solid state lighting device 24A is turned off. The solid state lighting device 24A may also comprise panels 30 that are arranged along a periphery of the optic 26 to reflect or otherwise redirect light in a desired direction. For many lighting applications, it may be desirable to present a uniform, soft light source without unpleasant glare, color striping, or hot spots. Thus, the panels 30 may comprise a diffuse white reflector in certain embodiments.

In FIG. 13, preferential reflectors 18J of a solid state lighting device 24B are provided on the panels 30 at locations outside of the optic 26 and the mixing chamber 28. In certain embodiments, emissions of the solid state light emitters 16-1, 16-2 may be mixed and/or diffused before being received by the preferential reflectors 18J. In such embodiments, the preferential reflectors 18J may be applied on the panels 30 or incorporated into portions of the panels 30. Accordingly, the preferential reflectors 18J may be visible when the solid state lighting device 24B is turned off. In certain embodiments, the preferential reflectors 18J are arranged to occupy only a portion of the panels 30, with one or more remaining portions of the panels 30 comprising a diffuse white reflector.

In FIG. 14, the submount 20 or housing of the solid state lighting device 24C, forms a pedestal 32 or protrusion on which the solid state emitters 16-1, 16-2 are mounted. In such an arrangement, one or more preferential reflectors 18K may be arranged on surfaces of the submount 20 that are adjacent to the pedestal 32 and below a horizontal plane on which the solid state emitters 16-1, 16-2 are mounted. By positioning the preferential reflectors 18K in such a manner, visibility of the preferential reflectors 18K through the optic 26 may be reduced when the solid state lighting device 24C is turned off.

Embodiments as disclosed herein are applicable to any number of lighting fixtures, including lighting fixtures configured for indoor and outdoor applications. Exemplary lighting fixtures may include troffers, downlights, suspending lighting, high-bay, low-bay, wall mount lighting, ceiling mount lighting, light bulbs, bulb replacements, parking garage lighting, and street lighting, among others. In such lighting fixtures, various arrangements of individually controllable solid state emitters configured to provide emissions of differing color points and one or more preferential reflectors may be provided depending on the particular application.

FIG. 15A is a top perspective view of a lighting fixture 34 that is arranged as a troffer style lighting fixture according to embodiments disclosed herein. The lighting fixture 34 comprises a troffer housing 36 that may be removably attached within a ceiling grid or other suitable support structure. For example, troffer style lighting fixtures may typically be configured for mounting into a drop ceiling (not shown) of a commercial, educational, or governmental facility. The lighting fixture 34 includes the optic 26 which forms the mixing chamber (28 of FIG. 12) and encloses solid state emitters and in some circumstances a light engine and/or additional electronics. A first end cap 38-1 and a second end cap 38-2 are disposed at either end of the optic 26 to facilitate mounting and attachment of the optic 26 to the troffer housing 36. In certain embodiments, one or more of the optic 26 and the end caps 38-1, 38-2 may be configured to be magnetically attached to the troffer housing 36. The panels 30 are arranged on either side of the optic 26. In certain embodiments, the panels 30 are provided as an integral single piece of the troffer housing 36, while in other embodiments, the panels 30 are separately formed and attached to or otherwise incorporated into the troffer housing 36. The troffer housing 36 may also support various other electronics and devices such as one or more of a driver, a power supply, control circuitry, an ambient light sensor, and the like. The lighting fixture 34 may typically be mounted in an overhead orientation such that light emissions are provided in a generally downward direction; however, the lighting fixture 34 may have other orientations.

FIG. 15B is a perspective view of the lighting fixture 34 of FIG. 15A with the optic 26 and the end caps 38-1, 38-2 removed. As illustrated, the first and second solid state light emitters 16-1, 16-2 may be arranged in a linear array along a central portion of the troffer housing 36. In certain embodiments, the first and second solid state light emitters 16-1, 16-2 may be arranged in an alternating manner within one or more columns. As previously described, the first and second solid state light emitters 16-1, 16-2 may be separately controllable relative to one another such that aggregate emissions of the lighting fixture 34 are tunable between multiple CCT values between respective emission color points of the first and second solid state light emitters 16-1, 16-2. As further illustrated in FIG. 15B, one or more of the preferential reflectors 18 may have a non-uniform spectral reflectivity that is configured to shift the aggregate emissions, such as toward the BBL in certain embodiments. In FIG. 15B, two preferential reflectors 18 are arranged along opposing lateral sides of the linear array of solid state light emitters 16-1, 16-2. Notably, the preferential reflectors 18 are arranged on portions of the troffer housing 36 that will be subsequently enclosed by the optic 26 of FIG. 15A. In this manner, the preferential reflectors 18 may be at least partially obscured from view by the optic 26.

FIG. 16A is a plot representing reflectance values across a wavelength range for three different configurations of preferential reflectors 18-1 to 18-3. In the plot, reflectance values are in arbitrary units for comparison across a wavelength range from 360 nm to 750 nm. The preferential reflector 18-1 demonstrates peak reflectivity values in a range including 500 nm to 550 nm with reflectivity values that are no more than half of the peak reflectivity for most wavelength values outside of such range. The preferential reflector 18-2 demonstrates peak reflectivity values in a range including 510 nm to 600 nm with reflectivity values that are no more than half of the peak reflectivity for most wavelengths below such range and reflectivity values that are between one half and the peak reflectivity values for most wavelengths above such range. The preferential reflector 18-3 demonstrates peak reflectivity values above 520 nm (e.g., 550 nm) and generally demonstrate similar reflectivity values all the way to 750 nm. Notably, all three preferential reflectors 18-1 to 18-3 demonstrate low reflectivity values below about 480 nm. Non-preferential reflectors such as white reflectors or metal reflectors generally have only small differences in reflectivity values across the visible spectrum.

FIGS. 16B-16E are plots of Du'v' versus CCT obtained by photometric testing of various configurations of the lighting fixture 34 of FIGS. 15A and 15B, with the differing configurations of the preferential reflectors 18-1 to 18-3. In each embodiment, state light emitters 16-1 were configured to provide emissions having a CCT of about 3000 K, while the solid state emitters 16-2 were configured to provide emissions having a CCT of about 5000 K, with aggregate emissions being tunable within a range including 3000 K to 5000 K. Photometric testing was performed across the 3000 K to 5000 K CCT range in 500 K increments to provide Du'v' measurements from the BBL for varying configurations of preferential reflectors 18-1 to 18-3. In FIGS. 16B-16E, a "control" data set represents configurations of the lighting fixture 34 of FIGS. 15A and 15B without any preferential reflector.

Figure 16B:
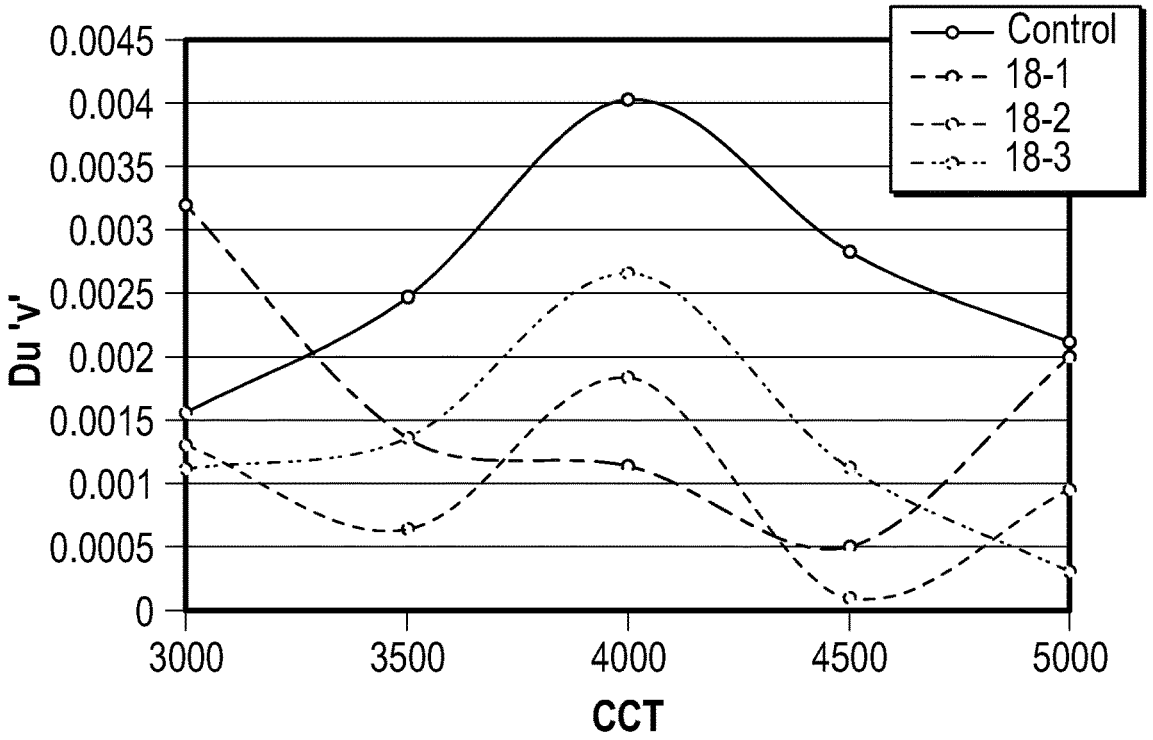

In FIG. 16B, the control data set shows lowest Du'v' values for aggregate emissions at the CCT values of 3000 K and 5000 K, corresponding to individual emissions of each of the solid state light emitters 16-1, 16-2. For CCT values that are tuned between the 3000 K and 5000 K values, the Du'v' values increase, indicating aggregate emissions that are farther away from the BBL, particularly for the center CCT value of 4000 K. For each of the data sets corresponding to the preferential reflectors 18-1 to 18-3, the surface area of the preferential reflectors 18-1 to 18-3 was kept constant at 40 square inches. As illustrated, the data sets corresponding to the preferential reflectors 18-1 to 18-3 demonstrate noticeable improvements in Du'v' values for aggregate emissions, particularly between CCT values of 3000 K and 5000 K. For example, the Du'v' value at 4000 K may be decreased or shifted from a value of 0.004 by at least 0.001, or by at least 0.002, or by at least 0.0025 by different ones of the preferential reflectors 18-1 to 18-3. Accordingly, preferential reflectors 18-1 to 18-3 are configured to shift Du'v' values in a range from 0 to at least 0.003 or more in certain embodiments. For the preferential reflector 18-1, the Du'v' value at 3000 K demonstrates an increase. In this regard, embodiments configured for the preferential reflector 18-1 may be better suited for tunable CCT values that are usually operated in middle portions of the 3000 K to 5000 K range.

Figure 16C:
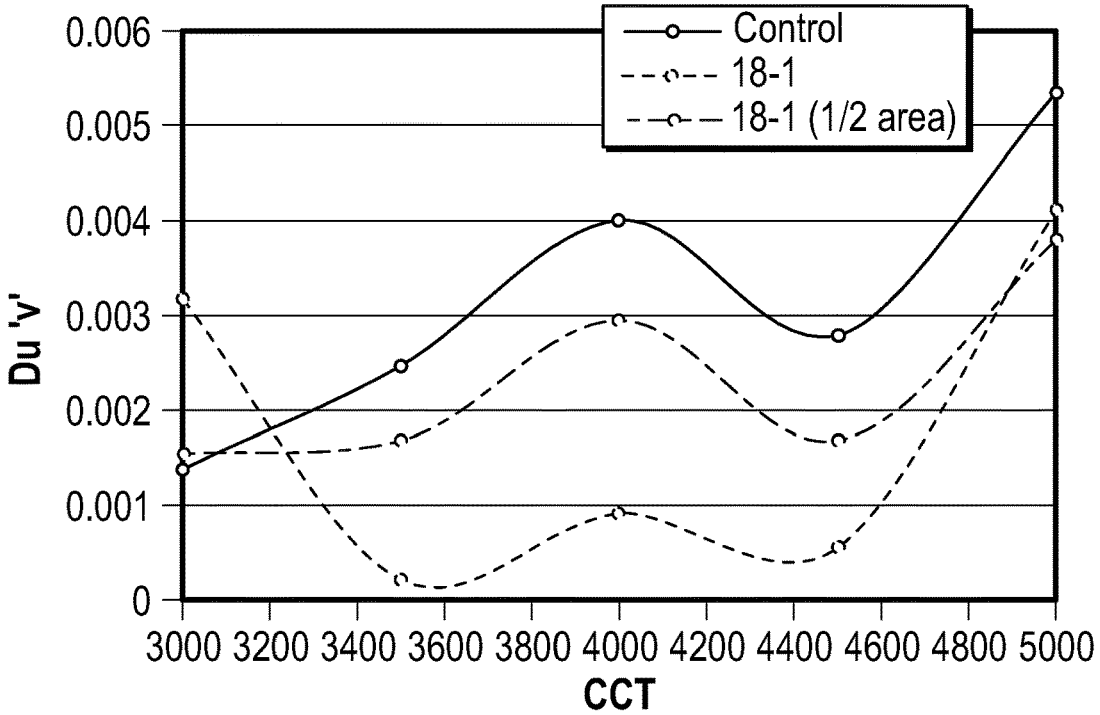
Figure 16D:
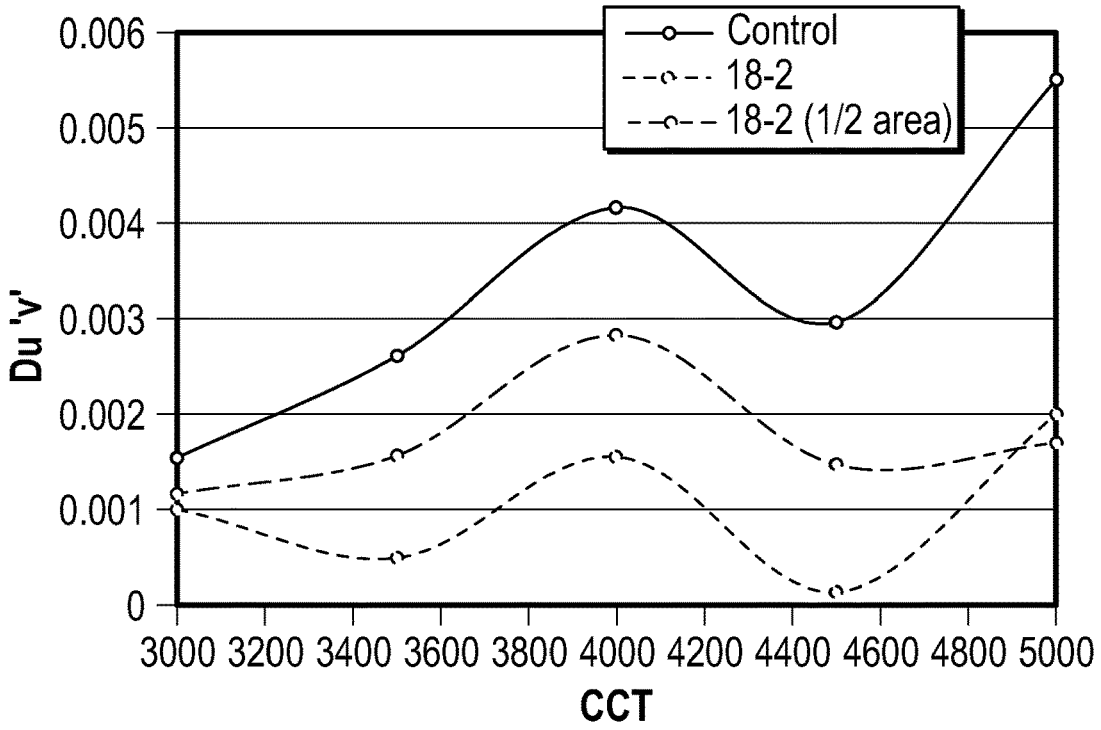
Figure 16E:
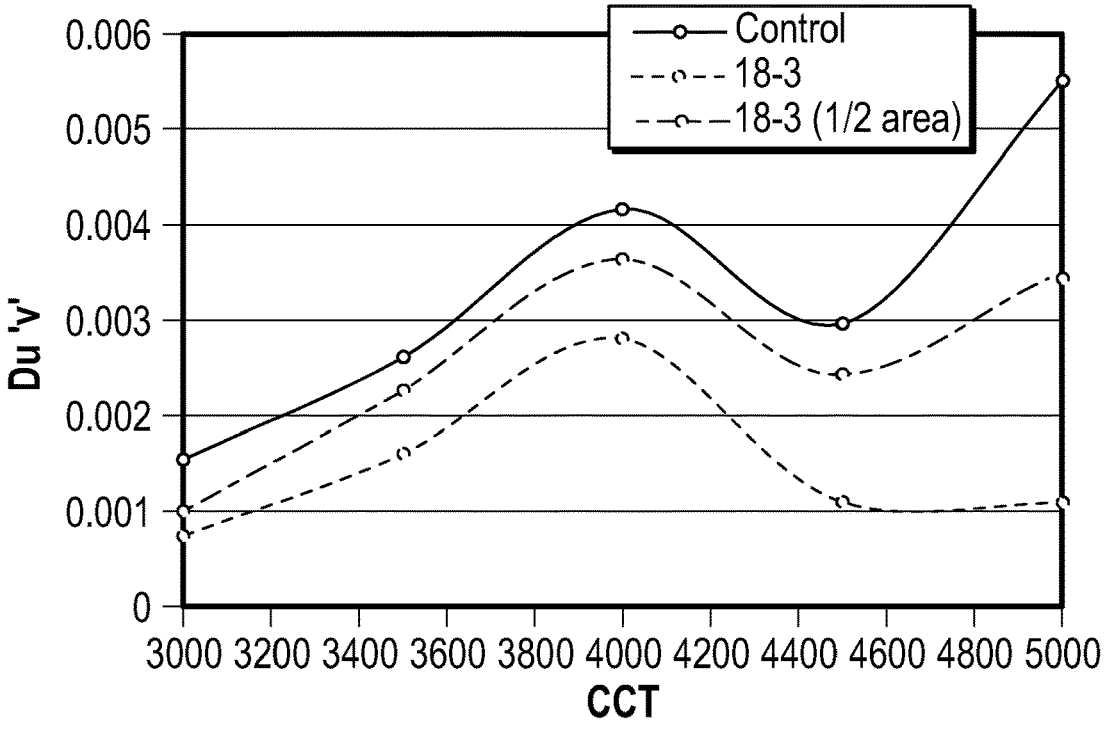

In FIGS. 16C-16E, the control data set shows a different curve than FIG. 16B, indicating different CCT values for each of the solid state light emitters 16-1, 16-2. In FIG. 16C, the preferential reflector 18-1 is configured with a surface area of 40 square inches. Similar to FIG. 16B, the preferential reflector 18-1 demonstrates notable improvements in Du'v' values (i.e., lower values corresponding to closer proximity to the BBL) in middle portions of the 3000 K to 5000 K range, but an increased Du'v' value at 3000 K. In particular, the preferential reflector 18-1 shows a shift in Du'v' values of at least 0.003. The preferential reflector 18-1 (½ area) represents the same preferential reflector but with half of the surface area (i.e., 20 square inches). In this regard, the Du'v' value is improved at 3000 K, but there is a trade off in the middle portions of the 3000 K to 5000 K range. In FIG. 16D, the preferential reflectors 18-2 and 18-2 (½ area) represent respective surface areas of 40 square inches and 20 square inches. In FIG. 16E, the preferential reflectors 18-3 and 18-3 (½ area) represent respective surface areas of 40 square inches and 20 square inches. In both FIGS. 16D and 16E, increased surface area for the preferential reflectors 18-2 and 18-3 corresponds with decreased Du'v' values throughout the 3000 K to 5000 K CCT range.

FIG. 17A is a perspective view of a lighting fixture 40 that employs an indirect light configuration with one or more preferential reflectors according to embodiments disclosed herein. In FIG. 17A, the lighting fixture 40 includes the troffer housing 36 and the panels 30 with a different arrangement of the optic 26. In particular, a support member 42 is provided along a central portion of the lighting fixture 40 with optics 26 on either side of the support member 42. In certain embodiments, the support member 42 comprises a heat sink for supporting and dissipating heat generated by one or more solid state light emitters 16-1, 16-2 that are mounted within the lighting fixture 40.

FIG. 17B is a cutaway perspective view of the lighting fixture 40 of FIG. 17A. As illustrated, the solid state light emitters 16-1, 16-2 may form a linear array on a face of the support member 42, such that the solid state light emitters 16-1, 16-2 are oriented to primarily emit light upwards toward a concave cover 44 of the lighting fixture 40. The volume bounded by the cover 44, the optics 26, and the support member 42 provides a mixing chamber 46 for the lighting fixture 40. As such, light will emanate upwards from the solid state light emitters 16-1, 16-2 toward the cover 44 and will be reflected downward through the respective optics 26 in a primary emission direction for the lighting fixture 40, as illustrated by the dashed arrows labeled as light rays in FIG. 17B. Notably, not all light rays emitted from the solid state light emitters 16-1, 16-2 will reflect directly from the bottom of the cover 44 and back through a particular optic 26 in a single reflection. Instead, many of the light rays will bounce around within the mixing chamber 46 and effectively mix with other light rays, such that a desirably uniform light is emitted through the respective optics 26. In certain embodiments, one or more preferential reflectors 18 may be provided within the mixing chamber 46 on portions of the cover 44. In this regard, the solid state light emitters 16-1, 16-2 are oriented away from the primary emission direction of the lighting fixture 40 and toward portions of the cover 44 that include the preferential reflectors 18. At least a portion of the emissions from the solid state light emitters 16-1, 16-2 may be received by the preferential reflectors 18 and reflected back toward the primary emission direction of the lighting fixture 40. In FIG. 17B, an electronics housing 48 is mounted at one end of the lighting fixture 40, and is used to house all or a portion of control circuitry used to control the solid state light emitters 16-1, 16-2 via cabling 52 and interface with various sensors, such ambient light sensors, occupancy sensors, or image sensors that may be present.

FIG. 18 is a perspective view of a lighting fixture 54 that forms a high bay/low bay type solid state lighting fixture. The lighting fixture 54 includes a frame 56 to which a heatsink 58 and an electronics housing 60 are mounted. An array of the solid state emitters 16-1, 16-2 is mounted on a bottom side of the frame 56 and may be covered by a lens 62. As illustrated, a portion of the lens 62 is shown as being removed to expose the solid state emitters 16-1, 16-2. A reflector 64 may be provided around the array of the solid state emitters 16-1, 16-2 to aid in directing and mixing light for general illumination. In certain embodiments, one or more preferential reflectors 18 as previously described may be provided for shifting aggregate emissions of the lighting fixture 54. In FIG. 18, the preferential reflector 18 is provided around a periphery of the solid state emitters 16-1, 16-2 and on the frame 56. In this manner, the preferential reflector 18 is arranged to receive emissions of the solid state emitters 16-1, 16-2 before such emissions exit the lens 62.

FIGS. 19A and 19B illustrate a lighting device according to embodiments disclosed herein, embodied in a substantially cylindrical downlight 66 intended for in-ceiling mounting and including multiple solid state emitters (e.g., 16-1, 16-2 of previous embodiments) as part of a LED module 68. FIG. 19A is a perspective view and FIG. 19B is a cross-sectional view of the downlight 66 illustrating a generally cylindrical base housing 70 and a heatsink housing 72 that in combination form a body structure. Mounting elements 74 such as rotatable spring tabs are arranged along an upper surface of the base housing 70. A cable 76 extends between the base housing 70 and an Edison (screw-type) male connector forming a threaded lateral contact 78 and a foot contact 80. The base housing 70 defines an interior volume 82 containing PCBs 84, 86 that include operative elements such a power converter, a controller module (e.g., including at least one processor and a memory), one or more transceivers (e.g., wireless transceivers), LED driver modules, sensor modules, detectors, voice recognition circuitry, and the like. The heatsink housing 72 defines an inner cavity 88 that includes a reflective surface 90 and is further bounded by a light transmissive optical element such as a lens and/or a diffuser 92. A trim bezel 94 is arranged proximate to an open end of the heatsink housing 72. The downlight 66 may include any suitable features disclosed herein, and is preferably arranged to execute any one or more functions and/or method steps described herein. In certain embodiments, one or more preferential reflectors 18 as previously described may be provided for shifting aggregate emissions of the downlight 66. In FIG. 19B, the preferential reflector 18 is provided on portions of the reflective surface 90 of the heatsink housing 72. In this manner, the preferential reflector 18 is arranged to receive emissions of the LED module 68 before such emissions exit the diffuser 92.

FIGS. 20A and 20B illustrate a lighting device according to embodiments disclosed herein, embodied in a light bulb 96 including the solid state emitters 16-1, 16-2 arranged in a two-dimensional array within a cavity bounded by a light transmissive globe or lens 98. The solid state emitters 16-1, 16-2 may be arranged on a single substantially planar emitter support surface 100, which may or may not be elevated by a pedestal 102. In other embodiments, the solid state emitters 16-1, 16-2 may be arranged in strips within an interior volume of the lens 98 to emulate the appearance of an incandescent filament. The light bulb 96 may include a body structure 104 having an associated external heatsink 106. An Edison (screw-type) connector including a threaded lateral contact 108 and a foot contact 110 extend from one end of the body structure 104 opposing the lens 98. The body structure 104 defines an interior volume containing at least one PCB (not shown) that includes operative elements such as a power converter, a controller module (e.g., including at least one processor and a memory), one or more transceivers (e.g., wireless transceivers), LED driver modules, sensor modules, detectors, voice recognition circuitry, and the like. The light bulb 96 may include any suitable features disclosed herein. In certain embodiments, one or more preferential reflectors 18 as previously described may be provided for shifting aggregate emissions of the light bulb 96. The preferential reflector 18 may be provided on portions of the planar emitter support surface 100 in certain embodiments. In this manner, the preferential reflector 18 is arranged to receive emissions of the solid state emitters 16-1, 16-2 before such emissions exit the lens 98.

FIGS. 21A and 21B illustrate a lighting device according to embodiments disclosed herein, embodied in a first outdoor floodlight (e.g., street or roadway lamp) lighting fixture 112. With reference to FIG. 21A, the lighting fixture 112 is mounted to a utility pole 114 by a tenon 116. The tenon 116 in this example extends outward from a top portion of the utility pole 114, and the lighting fixture 112 is attached to a free end of the tenon 116. The bottom of the utility pole 114 may be mounted to a pole base 118, which is securely mounted in or on the ground or other surface. As provided herein, the tenon 116 is defined as the mounting structure to which the lighting fixture 112 is directly mounted. The tenon 116 may be an integral extension or part of the utility pole 114, attached to the utility pole 114, or attached directly to a structure other than a pole, such as a building, wall, frame, sign, and the like.

In certain embodiments, the lighting fixture 112 has a housing 120 in which a light source 122 and an ambient light sensor 124 are mounted. In normal operation, the ambient light sensor 124 provides information bearing on ambient light levels, and based on these ambient light levels, the light source 122 will turn on and off. When ambient light levels fall below a certain level, the light source 122 will turn on, and when ambient light levels rise above a certain level, the light source 122 will turn off in traditional fashion. While the light source 122 may take various configurations, the one illustrated in FIGS. 21A-21B incorporates solid state emitters (e.g., 16-1, 16-2) and sufficient control circuitry to independently drive the solid state emitters as desired in response to information provided by the ambient light sensor 124 as well as any other sensors, such as occupancy, motion, sound, vibration, temperature, and like sensors, as well as a wired or wireless controllers. As described further below, an access cover 126 provides access to the interior of the housing 120. Such access may facilitate connecting the light source power as well as securely attaching the lighting fixture 112 to the tenon 116. In some embodiments, the access cover 126 is hinged at the rear of the housing 120 and rotates downward to provide access to the interior of the housing 120. The access cover 126 may use various mechanisms to lock into a closed position. These mechanisms may range from fasteners, such as screws and bolts, to snap-fit and magnetic configurations.

The housing 120 and the access cover 126 may be formed using an over-molding process that employs various mold compounds, such as thermoset bulk molding compounds, fiber reinforced thermoplastics, or un-filled thermoplastics. These mold compounds may be polymer based, but are not limited thereto, and may include various types of fibers, such as glass fibers, for reinforcement. With an over-mold process, the housing 120 and the various features thereof may be integrally formed as a single structure. Further, various features that are provided on or within the housing 120 may be affixed to, surrounded by, or otherwise formed within the structure. The tenon 116 may be formed from the same or different materials as the housing 120. In various embodiments, the tenon 116 may be formed from metals, such as, aluminum and steel, as well as from composite materials, such as carbon reinforced polymers and the like. An opening at the rear of the lighting fixture 112 may be referred to as a tenon cradle 128 that is configured for receiving the tenon 116. As previously described, the light source 122 includes solid state emitters (e.g., 16-1, 16-2 of previous embodiments) and sufficient control circuitry to independently drive the solid state emitters. The light source 122 may further include one or more lenses or reflectors configured to direct light in a desired emission pattern. In certain embodiments, the light source 122 includes a waveguide, or a waveguide optic, configured to receive light from the solid state emitters and direct it in a desired emission pattern. In certain embodiments, one or more preferential reflectors as previously described may be provided for shifting aggregate emissions of the light source 122. The preferential reflector may be provided near the solid state emitters and between the housing and one or more of a lens, a waveguide, and a waveguide optic depending on the embodiment.

Embodiments as disclosed herein may provide one or more of the following beneficial technical effects: providing solid state lighting fixtures that are tunable between multiple CCT values along or near the BBL; reducing complexity and costs associated with CCT-tunable solid state lighting fixtures; and improving color mixing and uniformity of aggregate emissions from CCT-tunable solid state lighting fixtures.

It is contemplated that any of the foregoing aspects, and/or various separate aspects and features as described herein, may be combined for additional advantage. Any of the various embodiments as disclosed herein may be combined with one or more other disclosed embodiments unless indicated to the contrary herein.

Those skilled in the art will recognize improvements and modifications to the preferred embodiments of the present disclosure. All such improvements and modifications are considered within the scope of the concepts disclosed herein and the claims that follow.

What is claimed is:

1. A solid state lighting device comprising:

at least one first solid state light emitter configured to produce first emissions having a first correlated color temperature (CCT);

at least one second solid state light emitter configured to produce second emissions having a second CCT, wherein the second CCT differs from the first CCT by at least 300 Kelvin (K); and a preferential reflector arranged to receive at least a portion of each of the first emissions and the second emissions, wherein the preferential reflector comprises a non-wavelength-converting material having a non-uniform spectral reflectivity exhibiting a peak reflectivity for wavelengths along a spectrum locus of a 1931 CIE Chromaticity Diagram within a range of 510 nanometers (nm) to 580 nm, the preferential reflector comprising at least one pigment material of a color corresponding to a wavelength within the peak reflectivity range.

2. The solid state lighting device of claim 1, wherein the at least one first solid state light emitter and the at least one second solid state light emitter are separately controllable relative to one another such that the solid state lighting device is tunable among multiple CCT values between the first CCT and the second CCT.

3. The solid state lighting device of claim 1, wherein the solid state lighting device is devoid of any solid state light emitters that are configured to provide emissions having a third CCT value that differs from both of the first CCT and the second CCT by more than 300 K.

4. The solid state lighting device of claim 1, wherein aggregate emissions of the solid state lighting device are tunable between multiple CCT values along a black body locus.

5. The solid state lighting device of claim 1, wherein the preferential reflector is configured to shift delta u'v' values of aggregate emissions of the solid state lighting device in a range between 0 and 0.004.

6. The solid state lighting device of claim 1, wherein the preferential reflector further comprises an adhesive tape that includes the at least one pigment material.

7. The solid state lighting device of claim 1, wherein the preferential reflector further comprises a binder, and wherein the at least one pigment material is embedded within the binder.

8. The solid state lighting device of claim 1, wherein the preferential reflector comprises a paint having the at least one pigment material mixed therein.

9. The solid state lighting device of claim 1, further comprising a housing and an optic defining a mixing chamber therebetween, with the at least one first solid state emitter and the at least one second solid state emitter being arranged within the mixing chamber.

10. The solid state lighting device of claim 9, wherein the preferential reflector is arranged within the mixing chamber.

11. The solid state lighting device of claim 9, wherein the preferential reflector is arranged outside of the mixing chamber.

12. The solid state lighting device of claim 9, wherein the housing forms a pedestal on which the at least one first solid state light emitter and the at least one second solid state light emitter are mounted, and the preferential reflector is arranged on a portion of the housing that is adjacent to the pedestal.

13. The solid state lighting device of claim 9, wherein the housing forms a portion of a troffer lighting fixture.

14. The solid state lighting device of claim 13, wherein the troffer lighting fixture comprises an indirect light configuration in which the at least one first solid state light emitter and the at least one second solid state light emitter are oriented away from a primary emission direction of the troffer lighting fixture.

15. The solid state lighting device of claim 9, wherein the optic comprises a lens.

16. The solid state lighting device of claim 9, wherein the optic comprises a waveguide optic.

17. A solid state lighting device comprising:

at least one first solid state light emitter configured to produce first emissions having a first correlated color temperature (CCT);

at least one second solid state light emitter configured to produce second emissions having a second CCT, wherein the second CCT differs from the first CCT by at least 300 Kelvin (K); and a preferential reflector arranged to receive at least a portion of each of the first emissions and the second emissions;

wherein the preferential reflector comprises a non-wavelength-converting material having a non-uniform spectral reflectivity, and aggregate emissions of the solid state lighting device are tunable between multiple CCT values along a black body locus, wherein the preferential reflector is configured to shift delta u'v' values of the aggregate emissions of the solid state lighting device in a range between 0 and 0.004.

18. The solid state lighting device of claim 17, wherein the solid state lighting device is devoid of any solid state light emitters that are configured to provide emissions having a third CCT value that differs from both of the first CCT and the second CCT by more than 300 K.

19. The solid state lighting device of claim 17, wherein the at least one first solid state light emitter and the at least one second solid state light emitter are separately controllable relative to one another such that the solid state lighting device is tunable among multiple CCT values between the first CCT and the second CCT.

20. The solid state lighting device of claim 17, wherein the second CCT differs from the first CCT by at least 2000 K.

21. The solid state lighting device of claim 17, wherein the at least one first solid state light emitter comprises a first light emitting diode (LED) chip and a first lumiphoric material that are configured to produce the first emissions, and the at least one second solid state light emitter comprises a second LED chip and a second lumiphoric material that are configured to produce the second emissions.

22. The solid state lighting device of claim 17, wherein the non-uniform spectral reflectivity exhibits a peak reflectivity within a range of 510 nanometers (nm) to 580 nm, and the preferential reflector comprises at least one pigment material having a color corresponding to a wavelength within the peak reflectivity range.

23. A solid state lighting device comprising:

at least one first solid state light emitter configured to produce first emissions having a first correlated color temperature (CCT);

at least one second solid state light emitter configured to produce second emissions having a second CCT, wherein the second CCT differs from the first CCT by at least 300 Kelvin (K); and a preferential reflector arranged to receive at least a portion of each of the first emissions and the second emissions, wherein the preferential reflector comprises a non-wavelength-converting material having a non-uniform spectral reflectivity exhibiting a peak reflectivity with a color point on a 1931 CIE Chromaticity Diagram including:

x, y coordinates that define a point on or within a closed shape bounded by a first line having x, y endpoint coordinates of (0.2806, 0.2883) and (0.0139, 0.7502);

a curve corresponding to a portion of a spectrum locus of the 1931 CIE Chromaticity Diagram having x, y endpoint coordinates of (0.0139, 0.7502) and (0.5125, 0.4866);

a second line having x, y endpoint coordinates of (0.5267, 0.4133) and (0.5125, 0.4866); and a curve corresponding to a portion of a blackbody locus of the 1931 CIE Chromaticity Diagram having x, y endpoint coordinates of (0.2806, 0.2883) and (0.5267, 0.4133).

24. The solid state lighting device of claim 23, wherein the preferential reflector exhibits reflectivity values for wavelengths in a range from 430 nm to 480 nm that are no more than half of the peak reflectivity.

* * * * *